US011103016B2

(12) United States Patent
Birkas

(10) Patent No.: US 11,103,016 B2
(45) Date of Patent: Aug. 31, 2021

(54) GARMENTS WITH UNIVERSAL FLY

(71) Applicant: Anna Birkas, Ukiah, CA (US)

(72) Inventor: Anna Birkas, Ukiah, CA (US)

( * ) Notice: Subject to any disclaimer, the term of this patent is extended or adjusted under 35 U.S.C. 154(b) by 119 days.

(21) Appl. No.: 16/450,622

(22) Filed: Jun. 24, 2019

(65) Prior Publication Data

US 2019/0328053 A1 Oct. 31, 2019

Related U.S. Application Data

(63) Continuation-in-part of application No. 15/132,159, filed on Apr. 18, 2016, now Pat. No. 10,362,810.

(51) Int. Cl.
*A41D 1/06* (2006.01)

(52) U.S. Cl.
CPC ..... *A41D 1/065* (2013.01)

(58) Field of Classification Search
CPC ..... A41D 1/065; A41B 9/005; A41B 9/007; A41B 9/004
See application file for complete search history.

(56) References Cited

U.S. PATENT DOCUMENTS

| | | | | |
|---|---|---|---|---|
| 4,578,828 | A * | 4/1986 | Smith, Sr. | A41D 1/065 2/234 |
| 9,408,418 | B2 * | 8/2016 | Blibech | D04B 35/34 |
| 10,362,810 | B2 * | 7/2019 | Birkas | A41B 9/001 |
| 2010/0281601 | A1 * | 11/2010 | Clarke | A41D 1/08 2/236 |
| 2015/0157058 | A1 † | 6/2015 | McCombs | |

* cited by examiner
† cited by third party

*Primary Examiner* — Tajash D Patel
(74) *Attorney, Agent, or Firm* — Lamon Patent Services; Cynthia S. Lamon

(57) ABSTRACT

A compound garment has a first garment of contiguous material from a waist band to a genital area, having opposite leg openings proximate the genital area, with at least a pelvic region made from a four-way stretch fabric, a second garment of contiguous material from a waist band to a genital area, having opposite leg openings proximate the genital area, with at least a pelvic region made from a four-way stretch fabric, and a waist band of non-stretch fabric, having a contiguous back portion and a front portion with a fly opening having closure elements enabling the fly opening to be opened and closed. The compound garment is formed by imposing the second garment over the first garment with waistband and leg openings aligned, imposing the non-stretch waistband over the assembled first and second garments, and joining the three along the waistband in the back.

19 Claims, 27 Drawing Sheets

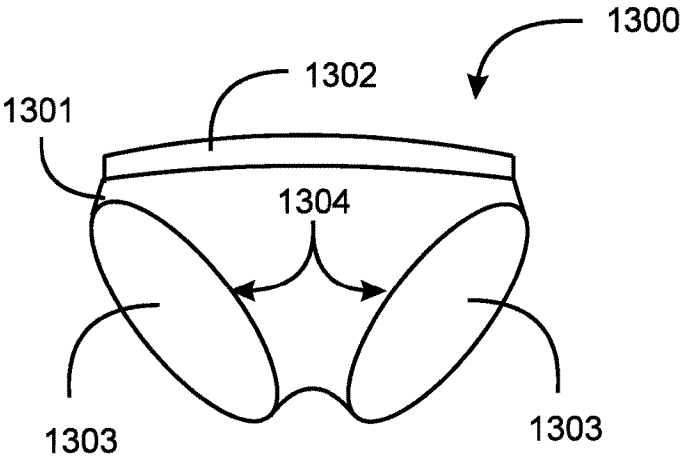
Fig. 13A
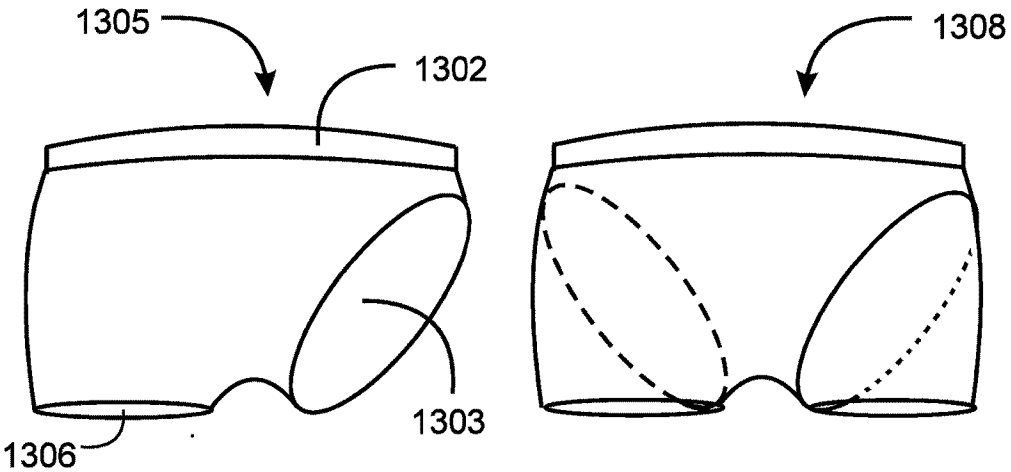
*Fig. 13B*
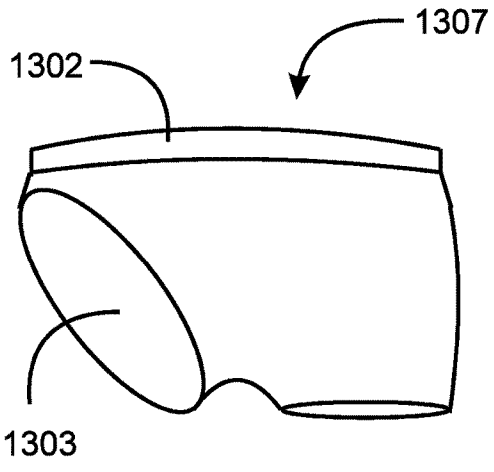
Fig. 13D
Fig. 13C

GARMENTS WITH UNIVERSAL FLY

BACKGROUND OF THE INVENTION

1. Field of the Invention

The present invention in the technical area of garments for human wear, and pertains more particularly to a garment having a unique structure providing for limited access from outside the garment to a wearer's genitalia.

2. Description of Related Art

Garments that cover a user's genitalia are well known, and such garments are known to provide genital access in several ways, such as by buttoned openings, zippered openings and simple fly structures of various sorts. Such access structures typically provide modest use for men, but are not so useful for women, who typically must partially remove a garment to urinate or defecate, for example, and in the process, if an enclosure like a private restroom is not available, the female user is forced to expose more of her anatomy than she might wish. There is therefore a need for a garment constructed to provide modest access to genitalia, that would be useful for both men and women, and would also allow a female user to keep most of her lower body not exposed in activities requiring access to the genitalia.

BRIEF SUMMARY OF THE INVENTION

In one embodiment of the invention a compound garment is provided, comprising a first garment of contiguous material from a waist band to a genital area, having opposite leg openings proximate the genital area, with at least a pelvic region made from a four-way stretch fabric, a second garment of contiguous material from a waist band to a genital area, having opposite leg openings proximate the genital area, with at least a pelvic region made from a four-way stretch fabric, and a waist band of non-stretch fabric, having a contiguous back portion and a front portion with a fly opening having closure elements enabling the fly opening to be opened and closed. The compound garment is formed by imposing the second garment over the first garment with waistband and leg openings aligned, imposing the non-stretch waistband over the assembled first and second garments, and joining the three along the waistband in the back.

In one embodiment the leg openings of the first and second garments are bikini-style openings. Also, in one embodiment the leg openings of the first and second garments are straight leg style openings. In one embodiment the compound garment further comprises legs of non-stretch fabric joined to the leg openings and extending downward. And in one embodiment the leg openings extend downward less than knee length.

In one embodiment the leg openings extend downward more than knee length. Also, in one embodiment the non-stretch waistband comprises a downwardly extending back region overlying the first and second garments, the back region comprising at least one pocket. Also in one embodiment the non-stretch waistband further comprises mirror-image front regions overlying the first and second garments, the front regions separated by the fly opening and extending downward to about the genital area, such that with the fly open, the front regions are enabled to fold back away from the first and second garments. In one embodiment the compound garment further comprises additional protectors joined to the front regions, covering a portion of the fabric legs below the front regions. And in one embodiment the additional protectors are joined at a lower extremity to the fabric legs by fasteners.

In one embodiment the additional protectors extend laterally around the lag portions. Also, in one embodiment the compound garment further comprises non-fabric side portions implemented on the second, outer garment, leaving the pelvic region as four-way stretch fabric. Also, in one embodiment the compound garment further comprises openable fastener elements, such as buttons, along front edges of the side portions, and a non-fabric front panel with mating fastener elements assembled across the front from side panel to side panel. In one embodiment the compound garment further comprises one or more pockets implemented on an outside surface of the non-fabric front panel. And in one embodiment the compound garment further compress openable fastener elements, such as buttons, along back edges of the side portions, and a non-fabric back panel with mating fastener elements assembled across the back from side panel to side panel.

In one embodiment the compound garment further comprises or more pockets implemented on an outside surface of the non-fabric back panel. In one embodiment the first and second garments are joined to a bottom edge of the non-fabric waist band.

In another aspect of the invention a compound garment is provided, comprising a first garment of contiguous material from a waist area to a genital area, having opposite leg openings proximate the genital area, with at least a pelvic region made from a four-way stretch fabric, and a first portion extending upward from the waist area, tapering to one side and ending in a shoulder strap of a substantial length, and a second garment of contiguous material from a waist area to a genital area, having opposite leg openings proximate the genital area, with at least a pelvic region made from a four-way stretch fabric, and a second portion extending upward from the waist area, tapering to a side opposite the one side and ending in a shoulder strap of a substantial length.

In one embodiment the compound garment further comprises a first non-fabric leg element joined to one leg opening of the first garment, and a second non-fabric leg element of the second garment joined one leg opening of the second garment, such that two side-by-side leg elements are presented.

BRIEF DESCRIPTION OF THE SEVERAL VIEWS OF THE DRAWINGS

FIG. 13A illustrates a bikini garment in an embodiment of the invention.

FIGS. 13B, C, and D illustrate a booty-shorts embodiment of the invention.

DETAILED DESCRIPTION OF THE INVENTION

The present invention provides in several embodiments a new garment that provides a universal fly structure that allows users to expose their private anatomy in a minimal manner when performing any activity involving the genitalia, such as urinating, defecating, or sexual access, among other uses.

In several embodiments of the invention there are two modular pormartions that are substantially mirrored in geometry. This unique structure is best described with reference to FIGS. 1*a*, 1*b*, 2*a* and 2*b*.

Figure 1A:
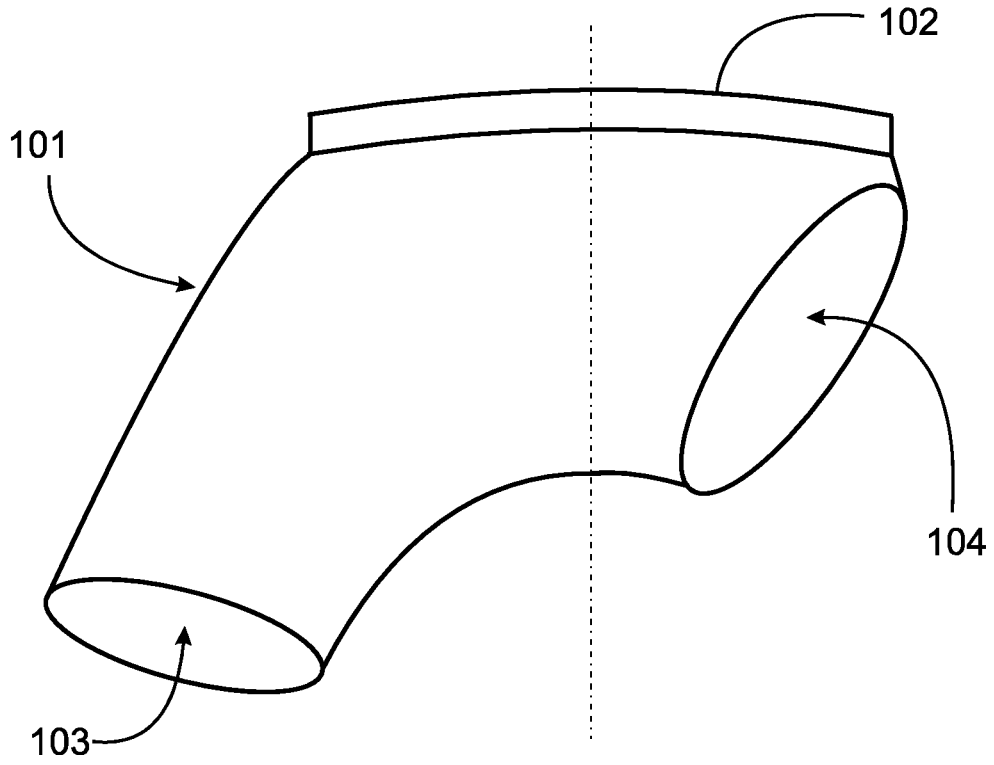
FIG. 1*a* is a perspective view of a portion of a garment in an embodiment of the present invention.

Referring to FIG. 1*a*, a first modular portion 101 of a garment according to an embodiment of the invention is illustrated. Portion 101 has a waist section 102, a body structure with a leg opening 103, and a side opening 104 opposite the leg opening. In this example it is assumed that the views are all in a direction to show the front of the garment and portions of the garment. However, the principle is the same if the views are taken as rear views.

Figure 1B:
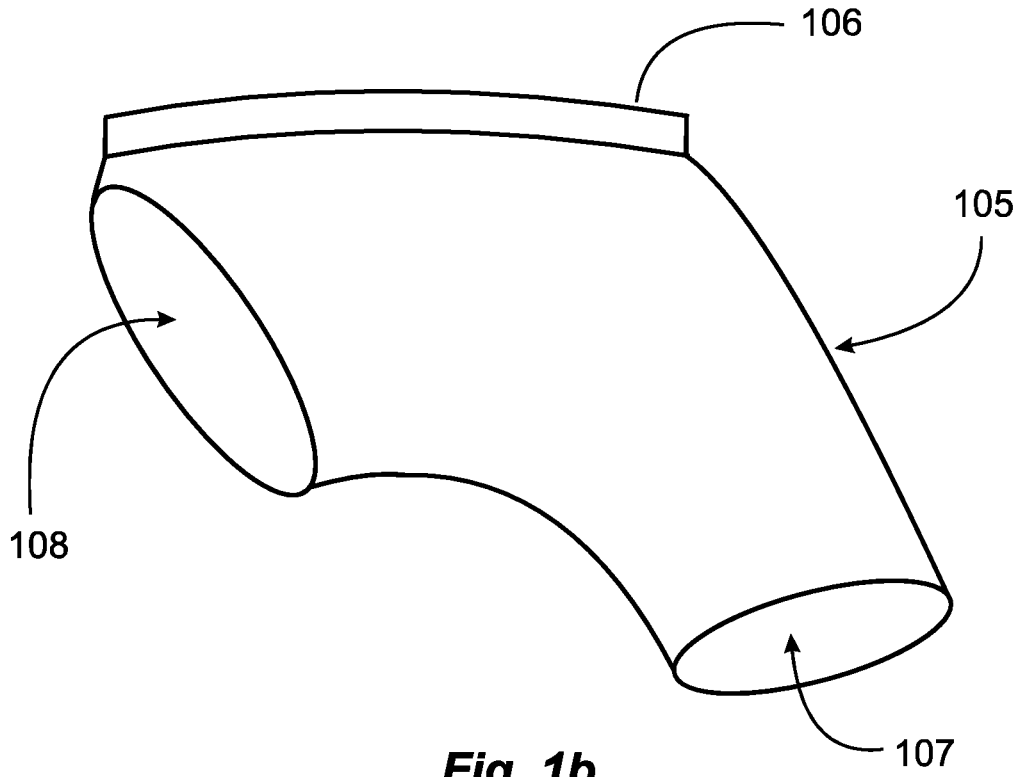
FIG. 1*b* is a perspective view of another portion of a garment according to an alternative embodiment of the invention.

FIG. 1*b* shows a second modular portion 105, which is essentially a mirrored image of portion 101 of FIG. 1*a*. Portion 105 has a waist section 106 essentially the same as waist section 102 of portion 101, a body having a leg opening 107, and a side opening 108 to the opposite side of the leg opening, and facing opposite the side opening 104 of portion 101. These two modular, mirrored portions assembled constitute a single garment according to an embodiment of the invention.

Figure 2A:
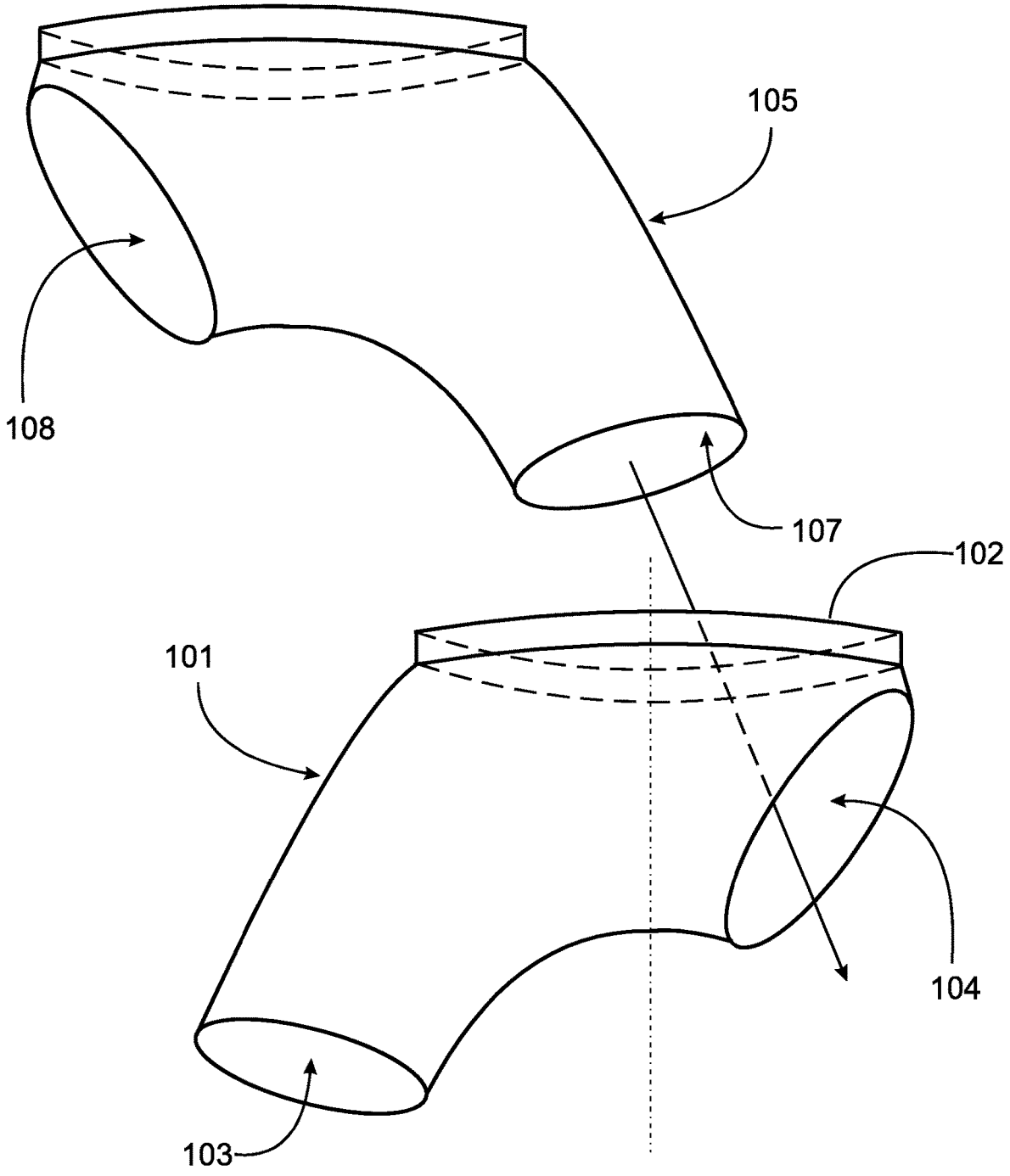
FIG. 2*a* is a perspective view of the garment portion of FIG. 1*b* being assembled to the garment portion of FIG. 1*a*, to make a complete garment according to an embodiment of the invention.

FIG. 2*a* shows the assembly of portions 101 and 105 into a single garment according to an embodiment of the invention. In this example portion 105 is inserted through the waist opening of portion 101, with the leg opening passing through side opening 104 to be again exposed to the outside.

Figure 2B:
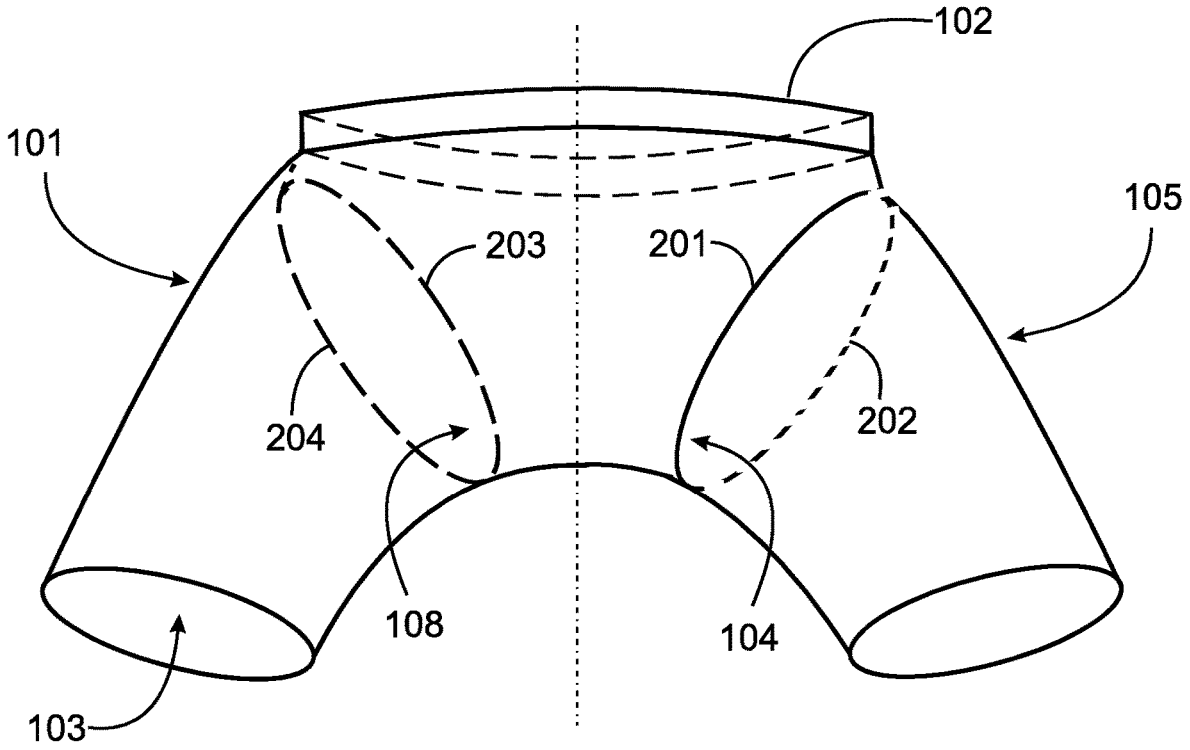
FIG. 2*b* is a perspective view of a garment resulting from the joining of the two portions in FIG. 2*a*.

FIG. 2*b* shows the result of the assembly. The resulting garment may have a single waist opening formed by joining, such as by sewing, the waist sections 102 and 106 of portions 101 and 105. In other embodiments the waist sections are not joined at all, but the two modular portions are separate as worn, but form the functional single garment.

In FIG. 2*b* the front and rear edges of openings 108 and 104 are labeled with element numbers. Opening 104 has a front edge 201 and a rear edge 202. It is important to note that both edges 201 and 202 lie outside the fabric of portion 105, which has leg opening 107, and that these edges are not joined to portion 105. A person wearing this garment could readily insert fingers of one hand under fabric of portion 101, either at edge 201 in the front or edge 202 in the back.

Now referring to edges 203 and 204 of side opening 108, these two edges, 203 to the front and 204 to the back, now lie under the fabric of portion 101, and may not be directly grasped by the wearer of the garment. Further to this description, it should be noted that the parts of the garment over each of a wearer's legs is of a single fabric thickness, but the part covering the front above the crotch, and the back over the user's buttocks, is a double thickness of fabric.

Figure 3A:
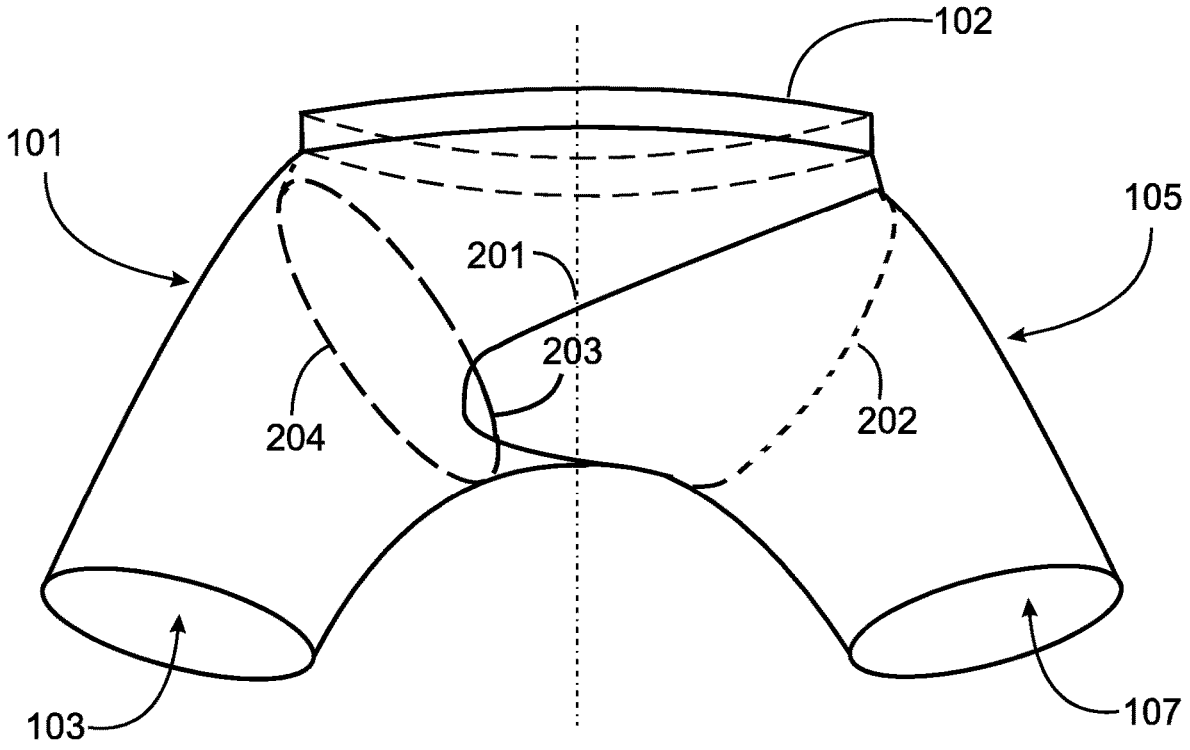
FIG. 3*a* is a perspective view of the garment of FIG. 2*b* in one step of use.

FIG. 3*a* is a front view of the garment of FIG. 2*b* in a particular use. This example assumes a particular flexibility and stretchable nature of the fabric of both modular portions 101 and 105. The fabric used for the modular portions may be a natural or synthetic and have a four-way stretch incorporating a stretch synthetic fiber such as Spandex, Lycra or elastane. Edges 201, 202, 203 and 204 may have additional elastic material incorporated in a sewn seam at the edges. The elastic material may be Latex rubber-band elastic swimwear tape, for example. The In FIG. 3*a* the wearer has grasped edge 201 in the front of the garment, and pulled (stretched) that edge across the front of the garment to just beyond edge 203 of opening 108. This pulling and stretching of edge 201 does not expose the wearer, except for a very small area indicated as 301, because the fabric of portion 105 underneath the fabric of portion 101 still covers the front of the wearer. A small part of edge 203 is now exposed, however, and the wearer can grasp that edge with the other hand, not used to stretch edge 201.

Figure 3B:
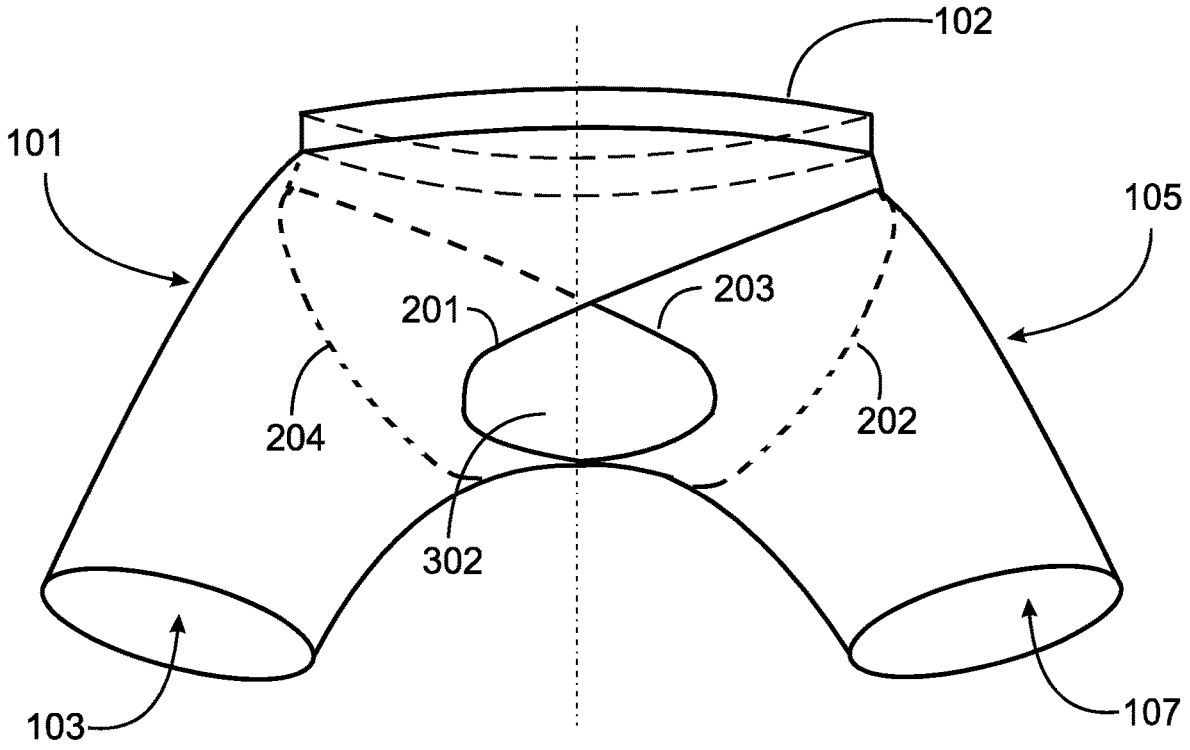
FIG. 3*b* is a perspective view of the garment of FIGS. 2*b* and 3*a* in another step of use.

FIG. 3*b* shows edge 203 stretched toward portion 105 about the same amount as edge 201 was stretched toward portion 101, and this action exposes area 302 of the user's front, and now an area 302 of the wearer's front, beneath both layers of fabric, is exposed. The wearer may perform this operation while standing, seated or squatting to expose the opening of the urethra to urinate. It is important to note that the area exposed is a function of where the wearer grasps the edges, and how far the wearer stretches the edges. A substantially smaller area, or a larger area could have been exposed to include both the genitalia and buttock region of the wearer. An important point is that the wearer has complete control over the exposure, and has no need to remove the garment, use any fasteners such as buttons or a zipper or lower the garment.

Figure 4:
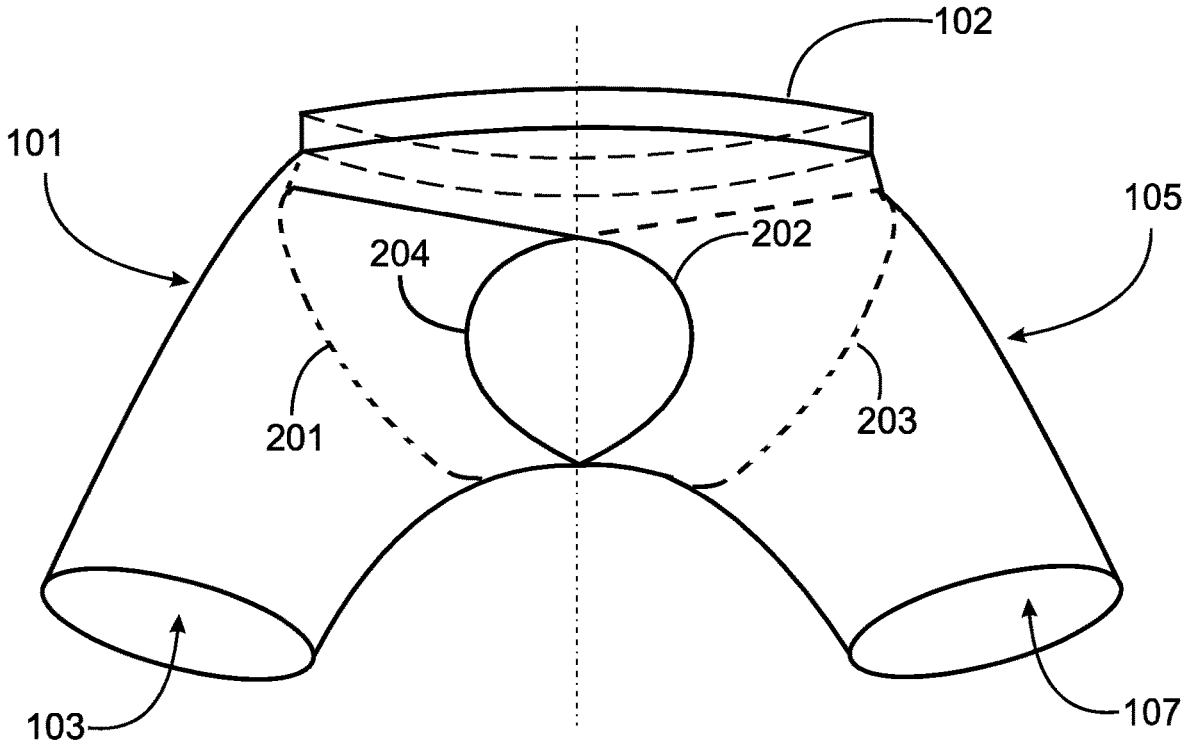
FIG. 4 is a perspective view of the garment of FIGS. 3*a* and 3*b*, seen from the rear, in another step of use.

FIG. 4 is a back view of the garment of FIG. 3*b*, and the user in this example has grasped first the exposed edge 202 and stretched that edge to the opposite side enough to grasp edge 204 with the opposite hand, and stretch that edge in the opposite direction that edge 202 is stretched. In this example the wearer has grasped the edges higher than in the example of FIG. 3*b*, and has exposed the wearer's buttocks (not shown). In a seated or crouched position this operation may be used to expose the anus to defecate. It is important to note that the user could easily have grasped the edges at a different position, and could pull up as well as across, to expose more or less of the wearer's backside.

In alternative embodiments fabric of many different sorts may be used, and certain details may differ, such as the construction of the waist portions. In one embodiment, for example, the waist area of the modular portions may not each encircle the wearer's waist, but each may encircle a portion of the wearer's waist, so that when joined the waist portions provide a complete circumference.

Figure 5A:
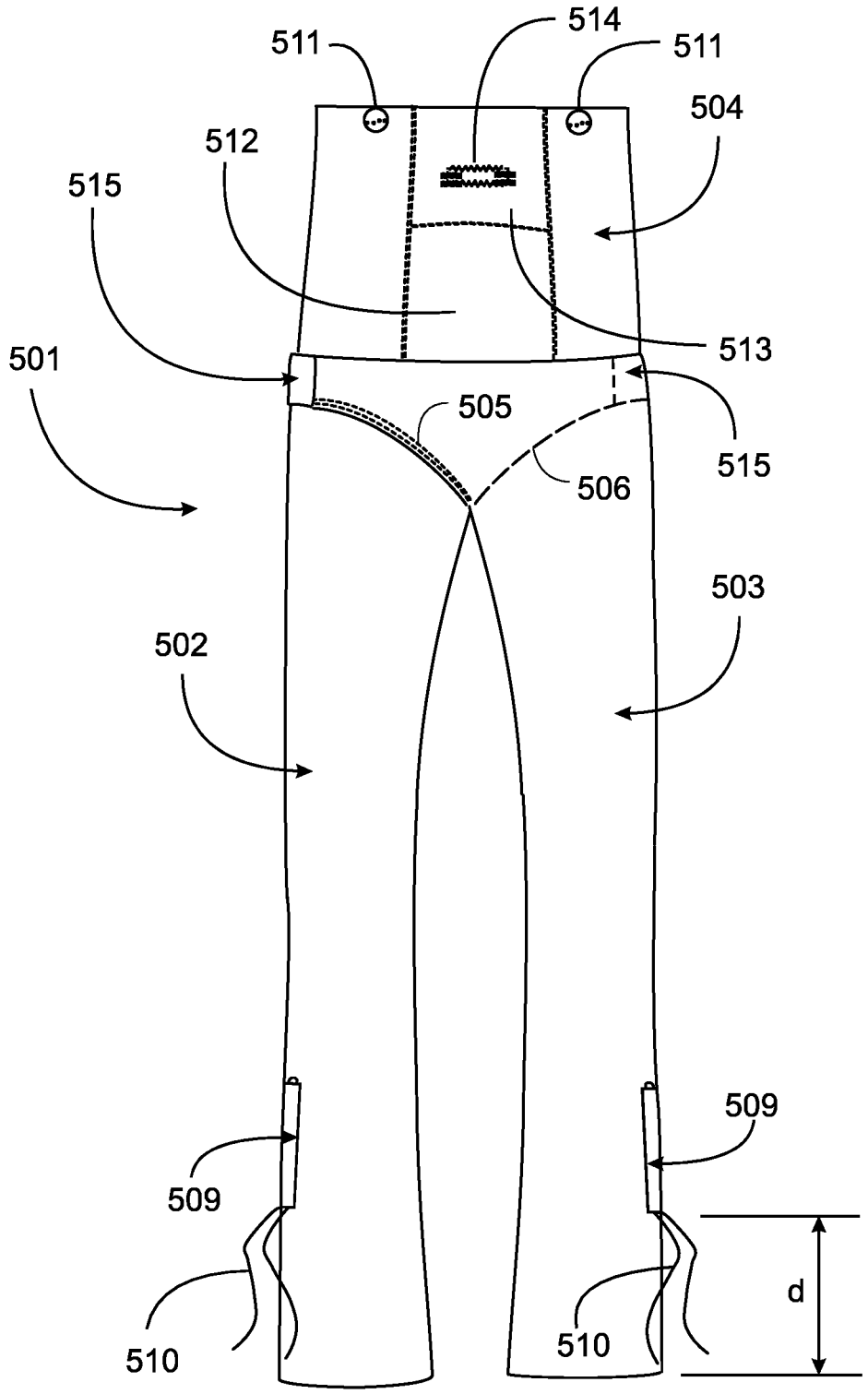
FIG. 5*a* is an elevation front view of a garment according to an embodiment of the invention.

FIG. 5*a* is an elevation front view of a garment 501 according to an embodiment of the invention, the garment having modular, substantially mirrored leg portions 502 and 503 each enclosing the full length of one of a user's legs. There is also in the garment of FIG. 5*a* an upper section 504 which may be provided as a contiguous part of portion 502, or 503, or partially by each of portions 502 and 503, or in some embodiments may be a separate portion provided to be worn in some circumstances along with garment 501.

Modular portion 503 of garment 501 is an outer portion, that is, the portion analogous to portion 101 of FIG. 2*b*, that provides the outer layer of material over the wearer's front torso and rear buttocks region. Edge 505 then, is the accessible edge that a user may first grasp and pull to the opposite side to be able to reach the hidden front edge 506 of portion 502, shown as a dotted line, which may then be grasped and pulled to expose an area of the wearer's front torso, such as the wearer's genitals. It will be apparent that edges 505 and 506 are front edges of openings that have also back edges not shown in FIG. 5*a*

Figure 5B:
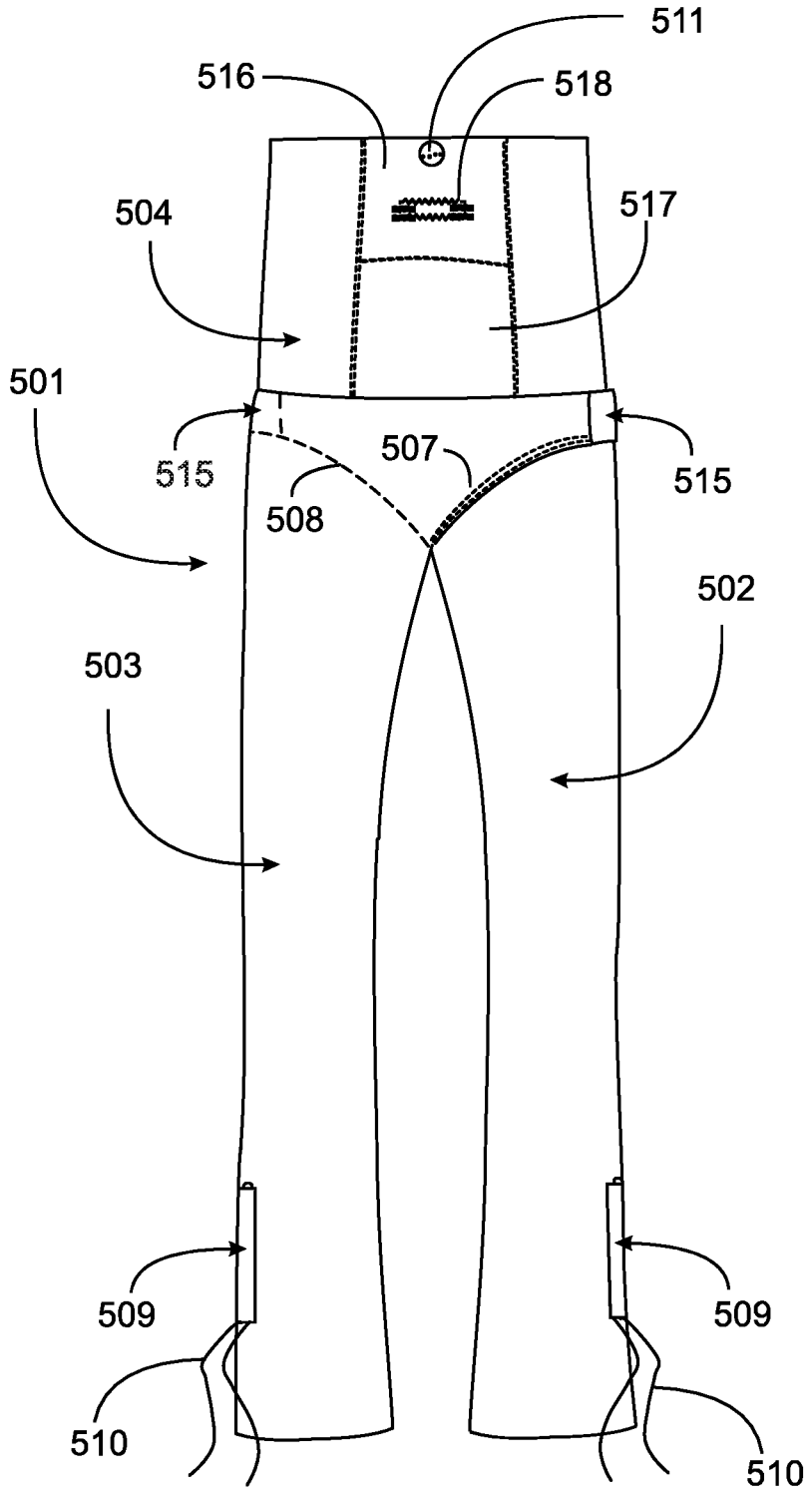
FIG. 5*b* is an elevation rear view of the garment of FIG. 5*a*.

FIG. 5*b* is a rear elevation view of garment 501 of FIG. 5*a*, so portions 502 and 503 appear reversed from their positions in FIG. 5*a*. Edge 507 is the back edge of the side opening of portion 503, of which edge 505 is the front edge. Hidden edge 508 is the back edge of the side opening of portion 502, of which edge 506 is the front edge.

As described above in regard to FIGS. 1-4, a wearer may grasp an exposed edge, pull the fabric aside to reveal a hidden edge of the portion beneath, may then grasp that edge and pull the fabric aside, to expose either the wearer's frontal torso or buttocks region, depending on whether the edges worked are in the front or the back of the garment.

Exposed edges 505 and 507 are illustrated as reinforced, which may be done in several ways. These edges in some embodiments of the invention are able to stretch substantially, and the fabric of the garment of the area above the crotch and to the side of the edge must also be a stretch material in these embodiments, so the fabric may be distorted to reach a concealed edge, and to stretch the concealed edge to expose the area of the wearer's body meant to be exposed by the wearer. In one embodiment the exposed edges, both front and back, and the concealed edges as well, are reinforced with a rubberlike material of about one-quarter inch in diameter. This is but one example, and not a limitation. This reinforcement causes the edges to follow the natural line and curve of the wearer's intersection between the upper thigh and the torso in the front.

In another embodiment of the invention a side patch, shown as element 515 in FIG. 5*a*, is implemented on both modular portions just at the hip area on the side opposite the leg portion, as shown in FIG. 5*a*. In this embodiment the material of the fabric that covers the torso area above the crotch area in both modular portions need not be as flexible and stretchable as in the embodiments without the side patch 515. This is because the side patch is made of material that is substantially stretchable with a considerable spring rate incorporating greater than 30% of a synthetic stretch fiber such as Spandex, Lycra or Elastane. In this embodiment, when the wearer grasps and edge and pulls the fabric aside, it is the side patch that stretches primarily, and provides force to return the fabric to its original form when released allowing edges 201 and 203 to return to an integral cleft region on each side of vaginal area and 202 and 204 to move back to position just under the buttocks.

A side patch 515 on modular portion 502 is not seen directly in FIG. 5*a*, because it is beneath fabric of portion 503, so is shown in dotted outline.

Figure 6:
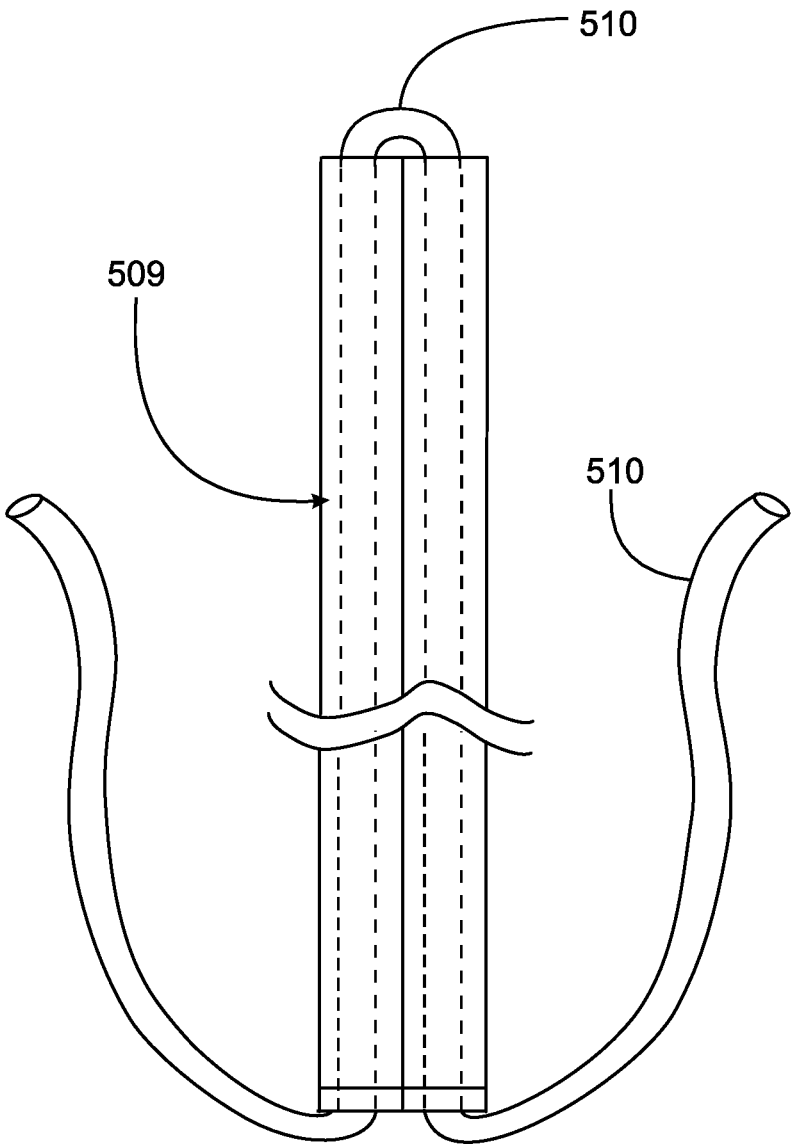
FIG. 6 is a side elevation view of an adjustment mechanism in an embodiment of the invention.

FIG. 6 is a side elevation view of an adjustment tie mechanism in an embodiment of the invention shown on the legs of the modular portions in FIG. 5*a* and FIG. 5*b*. Two fabric tubular structures are sewn side-by-side to form structure 509, which may be sewn to the outside of the leg portions, but could be anywhere about the circumference of the leg, and may be implemented at any height on the leg. In a preferred embodiment, however, the adjustment tie mechanisms are joined to the legs of the modular portions at a height "d", seen in FIG. 5*a*, that is maintained in many embodiments at from about 4 inches to about 6 inches. This structure is open at both ends at the top and bottom, and in one embodiment a cord 510 is threaded through one tubular structure 509 from below, out at the top, then down through the other tubular structure as shown, leaving a length of the cord exposed from each end at the bottom. It should be apparent that the cord in some embodiments might be threaded in from the top, rather than from the bottom.

The structure and cord allows a wearer to pull up and tie the leg to a truncated length, either at the end of the leg, or at an intermediary place along the height of the leg. The tubular structure may be of different lengths and diameter, and the cord may be of any one of a variety of different materials, and in a variety of different colors.

Figure 7B:
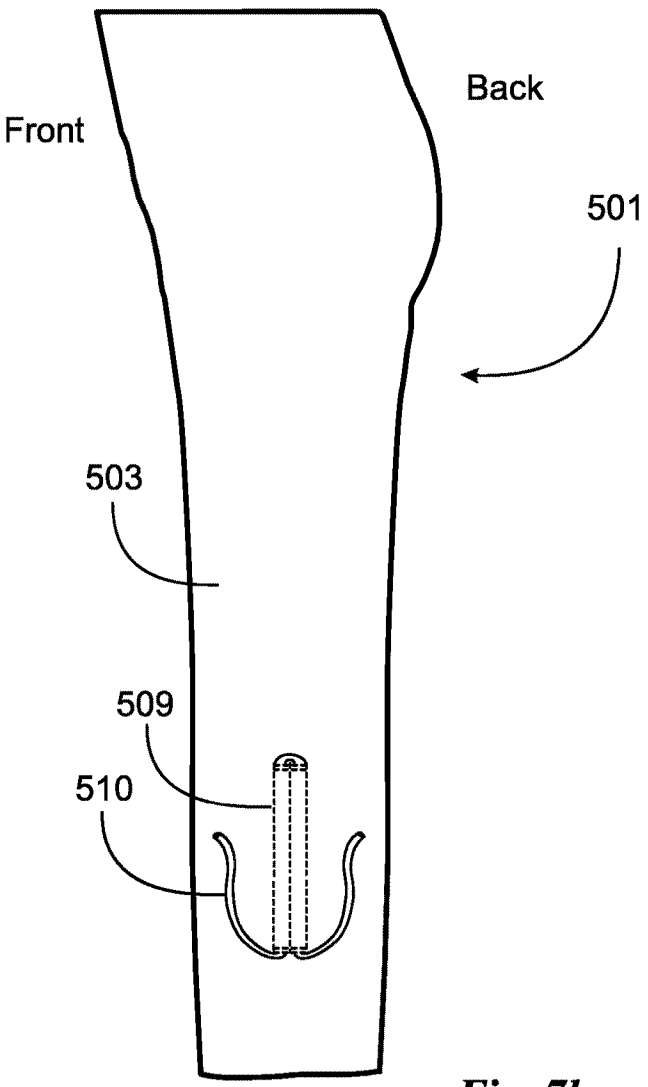
FIG. 7*b* is an elevation view of the left side of the garment of FIG. 5*a*.
Figure 7A:
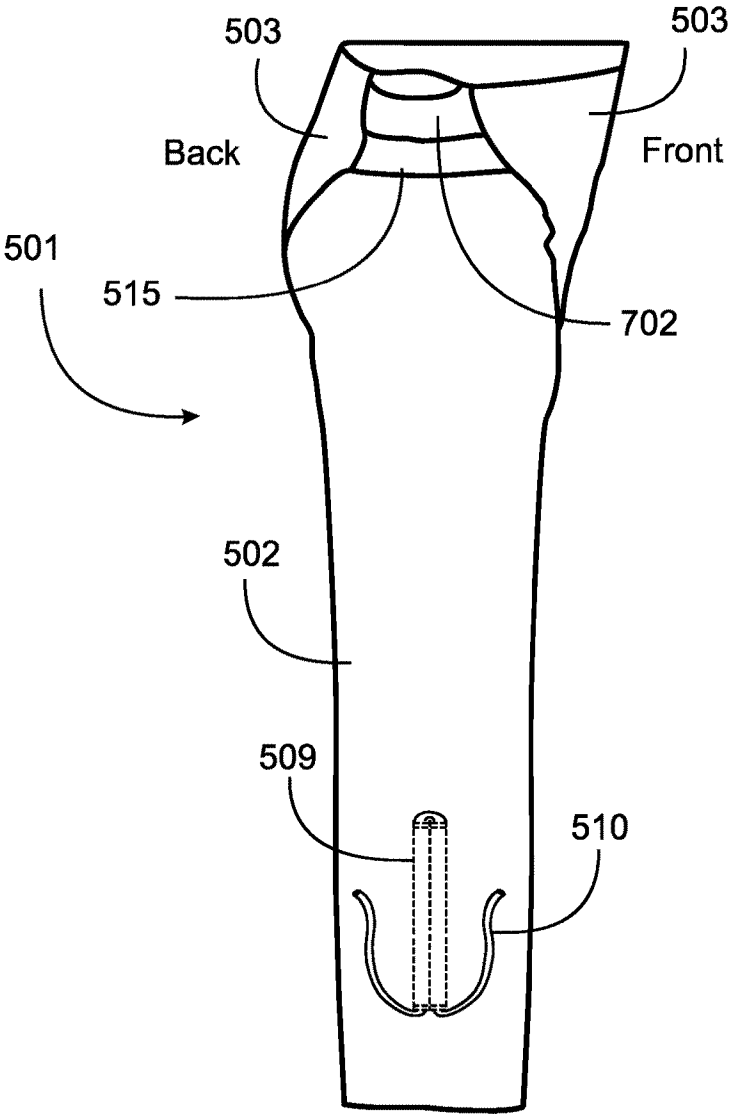
FIG. 7*a* is an elevation view of the right side of the garment of FIG. 5*a*.

FIG. 7*a* is an elevation view of the right side of the garment of FIG. 5*a*, and FIG. 7*b* is an elevation view of the left side of the garment of FIG. 5*a*. Front and back are indicated in both views. In FIG. 7*a* the leg seen from the right side is a part of modular portion 502, which may be considered the inner portion, providing hidden edges that can only be accessed after the wearer pulls the exposed edge (either front or rear) of the opposite portion 503. The exposed edges of portion 503 above the crotch area are seen in FIG. 7*a*. The adjustment tie mechanism 509/510 is illustrated in both the right and the left side views, and at the preferred height "d" shown in FIG. 5*a*. Side patch 515 is seen on the hip area, and also in this embodiment a loop element 702, which may be used for carrying a water bottle for example, or a utensil. The characteristics and functions of side patch 515 are described elsewhere in this specification.

Referring now to FIG. 7*b*, showing the left side, the fabric goes unbroken up to the waist height, because this is the outside modular portion. It will be apparent to the skilled person that outside/inside is simply a matter of choice in assembly of the two modular portions. A choice may well be made based on whether a garment is meant for a person who is right-handed or left-handed.

Figure 8:
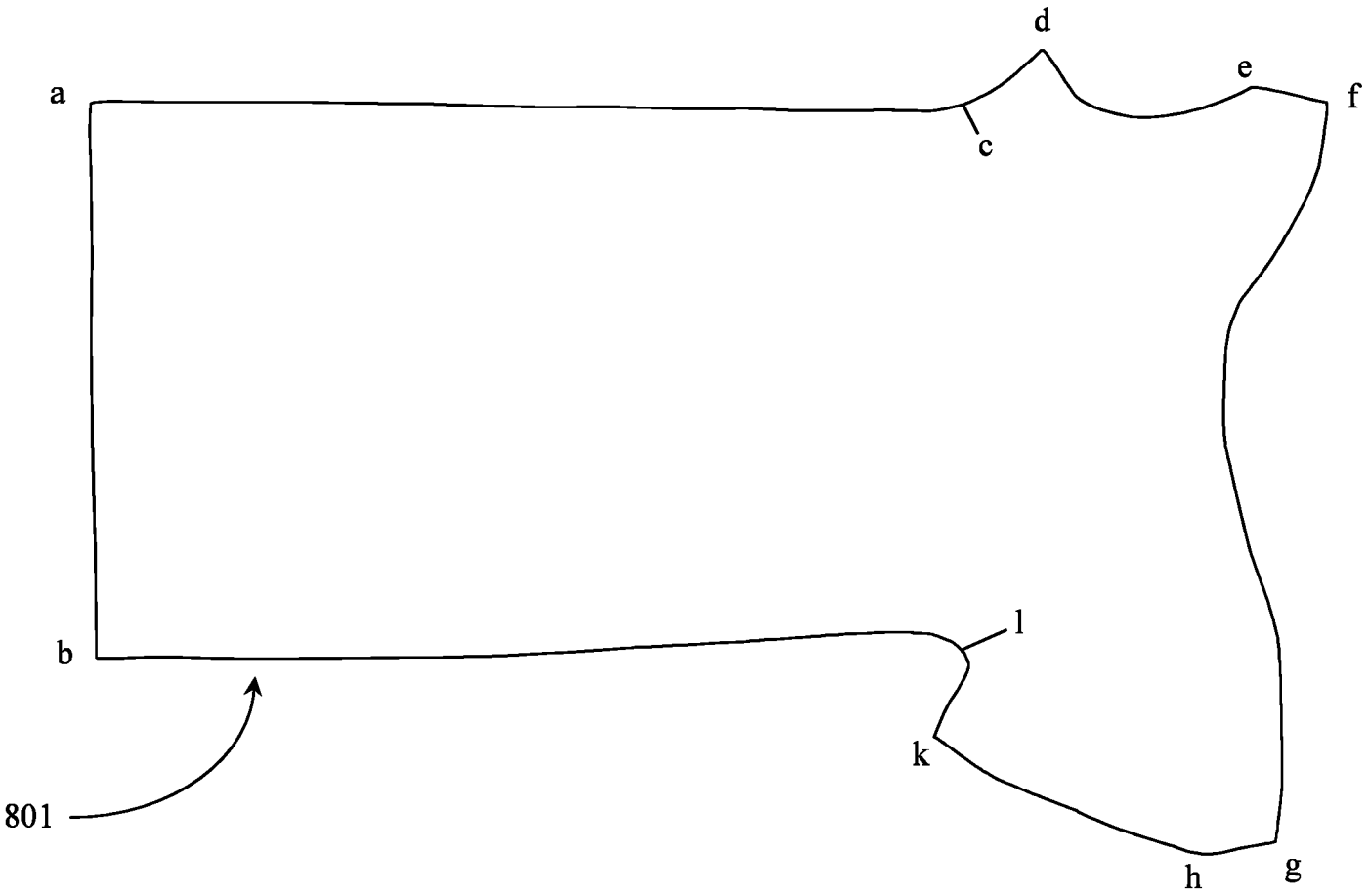
FIG. 8 is a flattened pattern of the shape and contours of a fabric panel that may be used to create either modular portion in an embodiment of the invention.

FIG. 8 is a flattened pattern of the shape and contours of a fabric panel that may be used to create either modular portion 502 or 503 in an embodiment of the invention. The edge of the fabric panel from a to b is of a length to provide the circumference of the bottom opening of the leg, at the ankle in a full-length embodiment. The leg height from the bottom opening to the crotch area is represented on one side by a to c, and on the other by b to l. These two dimensions will be the same.

In implementing a modular portion from the fabric panel in the size and shape shown in FIG. 8, one sews edge a-d to edge b-k. The seam from a/b to c/l will be essentially straight, and the result will provide the leg covering of the modular portion. The curved portion c/l sewn to d/k provides a turn in the seam at the top, so the leg portion seam does not terminate at the side of the crotch that the leg portion serves, but at the opposite side of the crotch. This is important, as otherwise the two assembled modular portions 502 and 503 would leave an open slit across the crotch from right to left in the assembled garment. The way the seam is provided caused there to be an overlap of fabric across the crotch area in the assembled garment. An obtuse angle formed by a/c/d and an acute angle formed by b/l/k, when sewn together form a horizontal seam across lower buttocks near crotch which is very important for forming edges 201, 202, 203 and 204 allowing overlap and keeping the openings, such as 302 of FIG. 3*b* closed when not in use.

Once the seam a/b to d/k is complete, one joins edge e-f to edge h-g, and sews the two edges together, which causes edge f-g to provide the waist opening. When this is accomplished, points e and h are together and points d and k are together, so edge k-h now forms one edge of the side opening, and edge k-h forms the other edge of the side opening, through which the second of the two modular portions may be passed to assemble two portions into a single garment. In some embodiments the fabric panel is dimensioned such that the side patch 515 can be sewn in place along edges e-f and h-g.

In one embodiment edge k-h, seen to be longer than edge d-e, forms the edge of the rear covering of the torso above the crotch up to the waist, and edge d-e, seen to be shorter, forms the edge of the front covering of the torso above the crotch area up to the waist.

One may turn pattern 801 over to mark and cut a second fabric panel to be used to implement the second of the two modular portions needed to form a single garment according to the invention. In some embodiments it may be desired that there be some differences in the two modular portions, especially in the region above the crotch area, which will require a separate pattern to mark and cut the fabric panel for the second modular portion.

It is not required that the fabric panel to form one modular portion be everywhere of a same fabric, a same thickness, a same flexibility or a same stretch characteristics. To provide special features in a finished garment according to an embodiment of the invention, one may add an extra layer of material in one or more areal portions of the fabric panel, may join different kinds of material together and then mark and cut, so one part of the modular portion is an entirely different material than another part, and may add insulation material to be on the inside of one part of the modular portion, such as lining the leg portion, for example. There are many possibilities.

Figure 9:
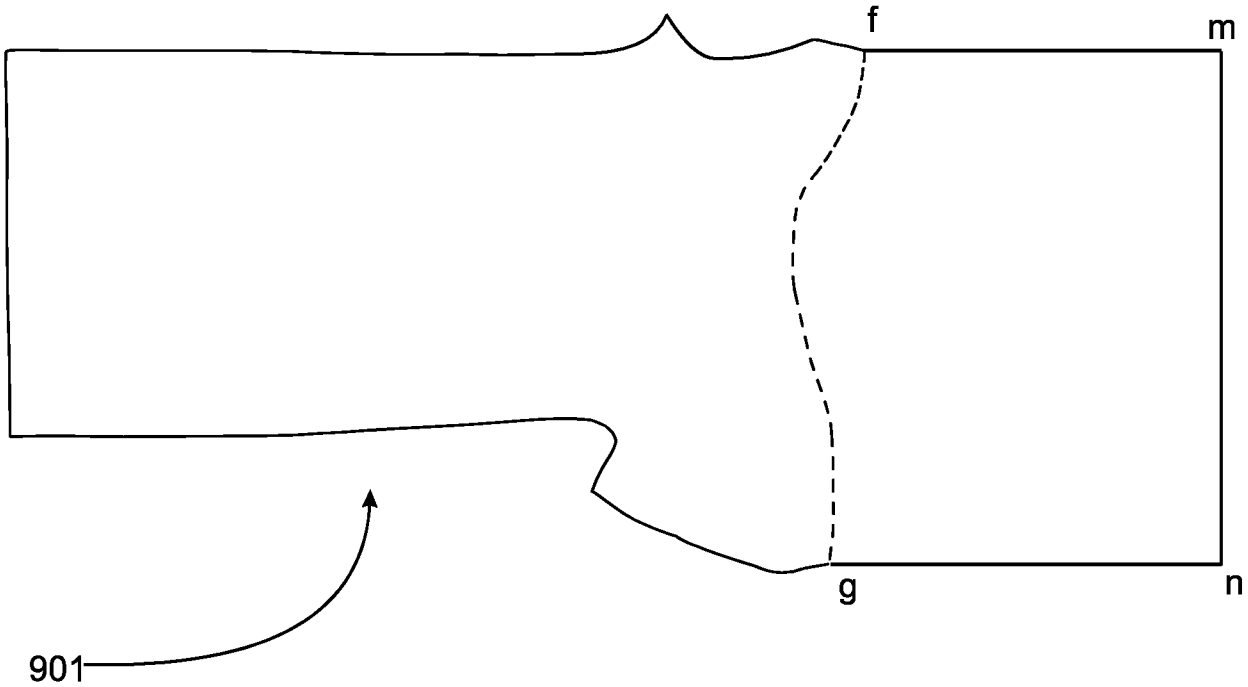
FIG. 9 shows a pattern providing an upper portion in an embodiment of the invention.

Referring again to FIGS. 5*a* and 5*b*, these figures additionally illustrate upper sections of a garment that have not as yet been described, either as to their nature, or as to how these parts might be accomplished. In FIGS. 5*a* and 5*b* the upper section is element 504, and is shown as a single unit. This may be accomplished by adding to the pattern of FIG. 8, along the edge from f to g, a new portion above the waist area. FIG. 9 shows a single example of such a pattern 901.

In FIG. 9, material has been added to the pattern, now indicated as pattern 901, from the waist line f-g up to m-n. When a fabric panel is prepared according to this pattern, and the leg edges are sewn together, the edge f-m may be similarly sewn to edge g-n, which will provide a single, tubular upper portion 504 as seen in FIGS. 5*a* and 5*b*. If the angle of f-m is changed to angle in somewhat, and the same for g-n, the upper portion may have a larger circumference at the waist than at the top, m-n.

It should be apparent to the skilled person, that an upper panel portion may be provided extending from either modular portion, simply by controlling the width and placement of the extended portion. By careful placement one may provide separate front and back extended portions, open at the sides, or many other effects.

Figure 10:
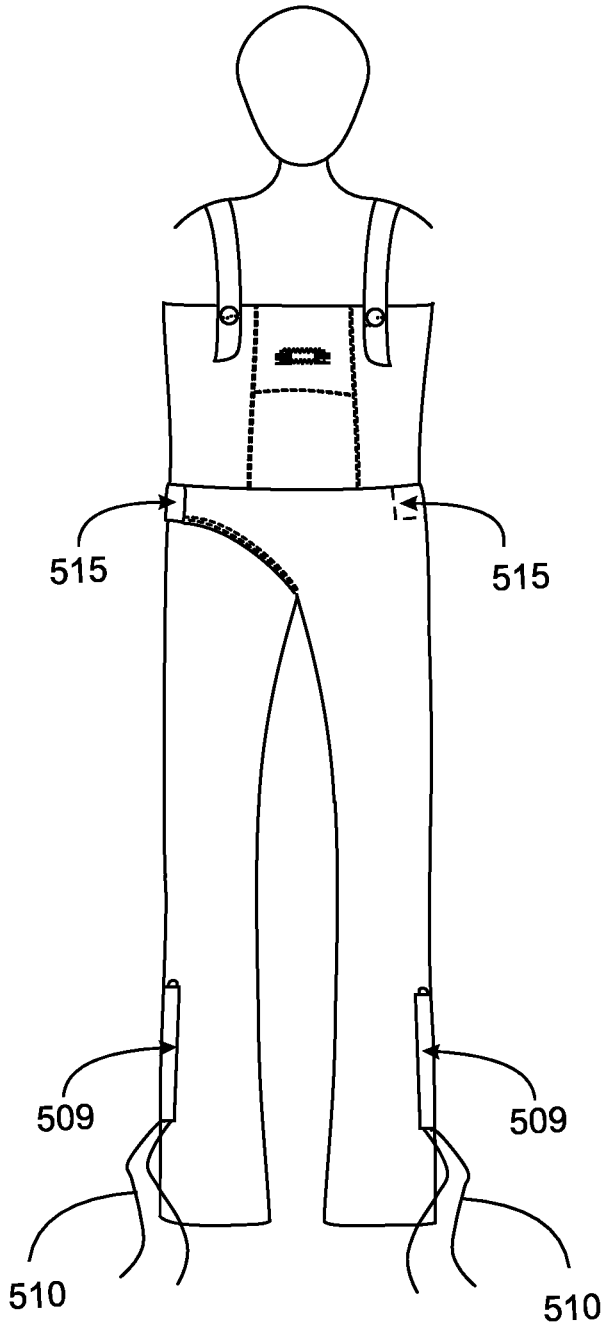
FIG. 10 shows a circumstance with buttons on the front connected to straps in an embodiment of the invention.

Referring again to FIG. 5*a*, two buttons 511 are shown added along the upper edge of the extended portion. These buttons may be used for connecting a neck strap or one or two straps that may pass over the wearer's shoulders and be buttoned to the upper portion in the back. This circumstance is shown in FIG. 10. Two pocket areas 512 and 513 are shown added as well in FIG. 5*a*, which pockets may be sewn on, or may be formed from separate layers of fabric used for the upper section. A pocket opening 514 is shown as well, and may be a zippered opening a buttoned opening, or may have no closure element. In an embodiment with no closure element, a synthetic elastic material such as the swim tape used for edges of openings may be incorporated in a seam around a pocket opening to hold items in the pocket. The pockets with elastic material and seam can actually hold items substantially larger than the pocket openings such as a water bottle, for example.

In one embodiment a pocket with an opening may be added on the inside of upper section 504, and that pocket may be accessible by pulling the upper section down over the torso section above the crotch area. In another embodiment, the upper portion may be made longer (higher) such that when pulled down will form a skirt over the torso part and an upper part of the leg sections. This circumstance is shown in FIG. 12.

Figure 12:
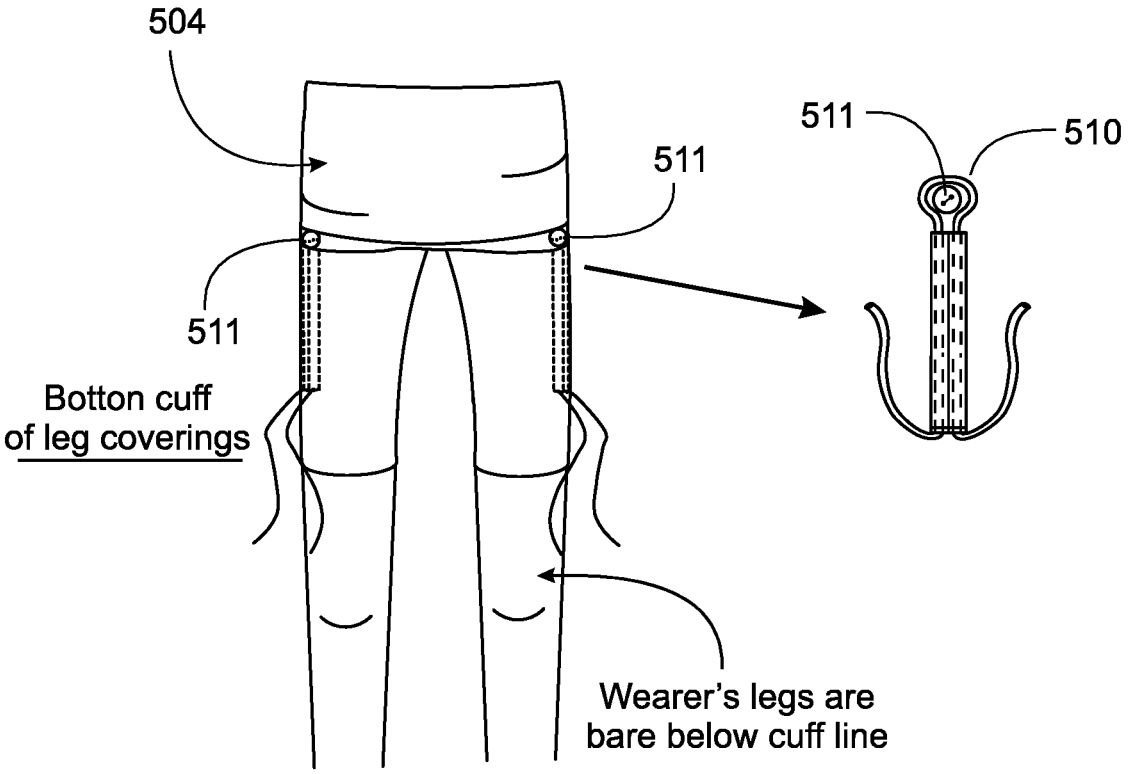
FIG. 12 shows an upper portion pulled down to act as a skirt portion in an embodiment of the invention.

FIG. 12 illustrates a garment according to an embodiment of the invention, wherein an upper portion 504 has been pulled down over the lower torso section of the garment, including at least the buttocks in back of the torso and the upper thigh of the front torso, such that buttons 511 (see FIG. 5*a*) are now at a height at or below the crotch area. In this example the adjustment tie mechanism 509 is located on the legs of the garment at the preferred height of from 4 to 6 inches, and the wearer pulls the tie mechanisms, and thus the pant legs up to place the loop of cord 510 at the height of buttons 511. Under this circumstance the wearer may loop cords 510 over buttons 511 and secure the pulled-down section 504 to the legs of the garment, with the legs of the garment raised as shown in FIG. 12, leaving the wearer's legs bare below the height of the cuff with the legs drawn up. The joining of the cord of the tie mechanism to the buttons is shown to the right in FIG. 12 as a magnified view.

Figure 11:
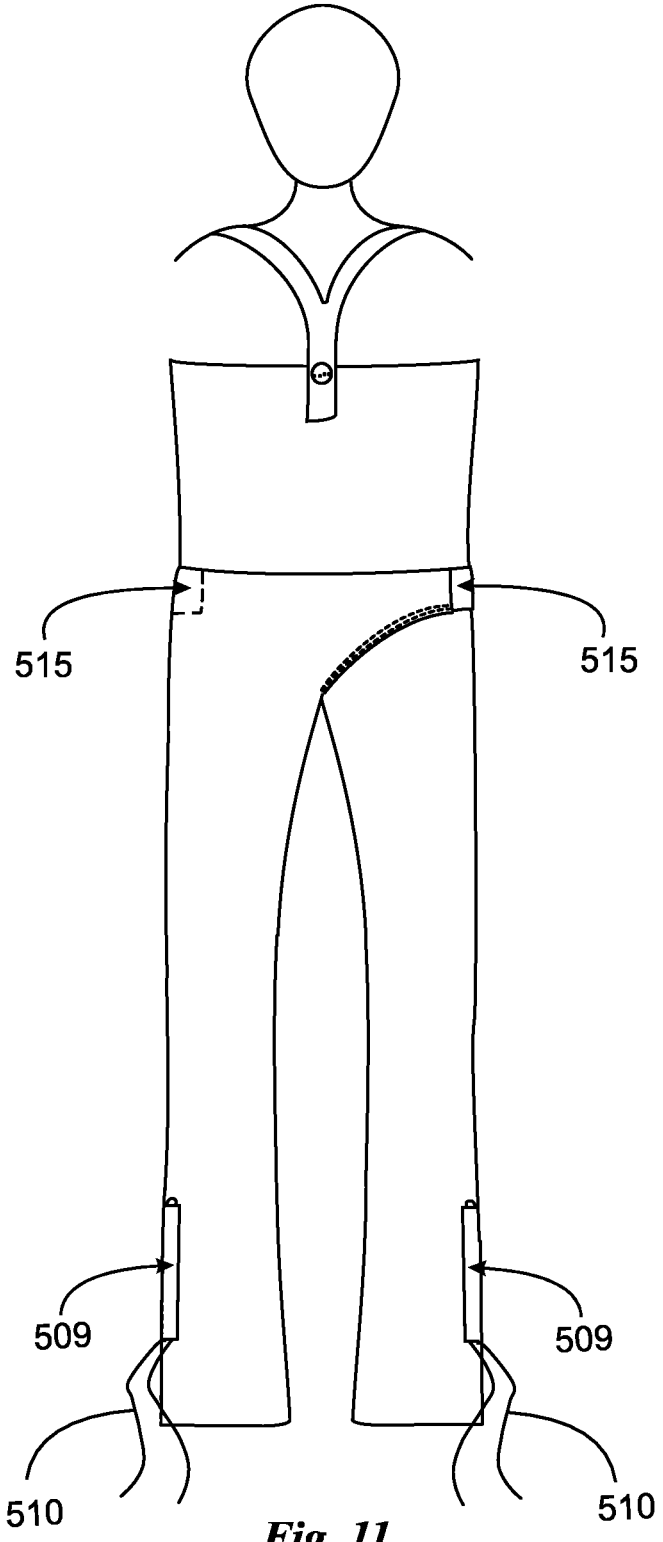
FIG. 11 shows an upper section from the back with a single button in an embodiment of the invention.

In FIG. 5*b* a single button 511 is shown about midway along the upper edge of the upper portion. This button may be used to connect commonly two straps from the buttons on the front, the straps passing over the wearer's shoulders. This circumstance is shown in FIG. 11. Additional pockets 516 and 517 may be added as well, and a pocket opening 518 analogous to 514 of FIG. 5*a*. It will be apparent that pockets may be added in many different ways for many different purposes.

FIG. 13A illustrates a bikini garment in another aspect of the invention. Referring back to FIGS. 1*a* and 1*b*, a first and a second version of an undergarment were described, wherein the first version had a longer leg on one side and the second version a longer leg on the other side, such that, with the first underneath and the second worn over the first, a user might grasp and pull one edge, exposing an edge of the version underneath, that might than be pulled aside, exposing the genitalia. The portions are made of a fabric that exhibits a four-way stretch, such as Spandex™, Lycra™ or Elastane™.

In FIG. 13A one bikini garment 1300 is shown, also of the stretch fabric described for the garment of FIGS. 1*a* and 1*b*. Garment 1300 has a waistband 1302, a body portion 1301 and two identical leg openings 1303. Two such bikini garments 1300 may be worn one over the other, and may be joined along a section of the waistband. The result provides a compound garment wherein edges 1304 may be manipulated as described for the garment of FIGS. 1*a* and 1*b*, to provide genital access. The joining along a portion of the waistband is a preference, and not a requirement in the invention.

FIG. 13B is an elevation view of a stretch garment 1305 that has one bikini-style leg opening 1303 and one straight leg portion with opening 1306. FIG. 13C shows a garment 1307 the same as garment 1305 as in FIG. 13B, but in a mirror image. A user may don one, and then the other over the first, as In FIG. 13D, providing a two-layer garment 1308 the inventor terms booty-shorts, which provide access to the genital area by alternately grasping and stretching the bikini opening elastic edges, just as described above in other embodiments.

In an alternative embodiment not specifically shown in the Figs. booty shorts may have straight legs in both the under layer and the over layer, instead of each layer having an opposite bikini leg opening. It may be shown that a user with the straight leg booty shorts may grasp the lower edge of the straight leg opening of the outer layer and pull across to expose the lower edge of the straight leg opening of the inner layer, which may then be grasped and pulled the opposite way to expose the genitals. In many embodiments described below the straight leg booty shorts are incorporated.

Figure 14B:
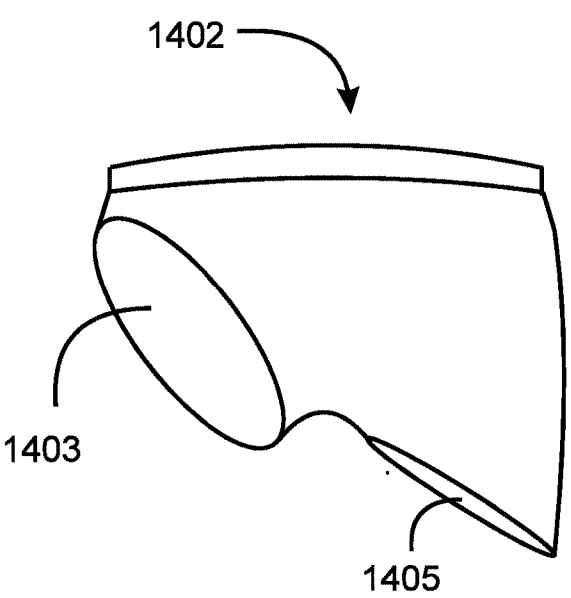
FIGS. 14A, B and C illustrate an embodiment similar to the booty-shorts of FIGS. 13B, C and D.
Figure 14C:
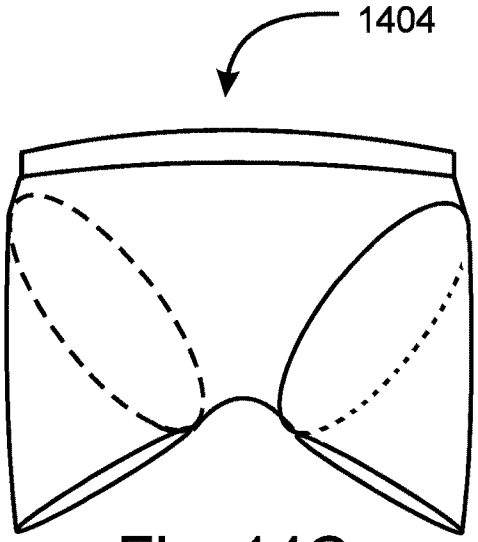
Figure 14A:
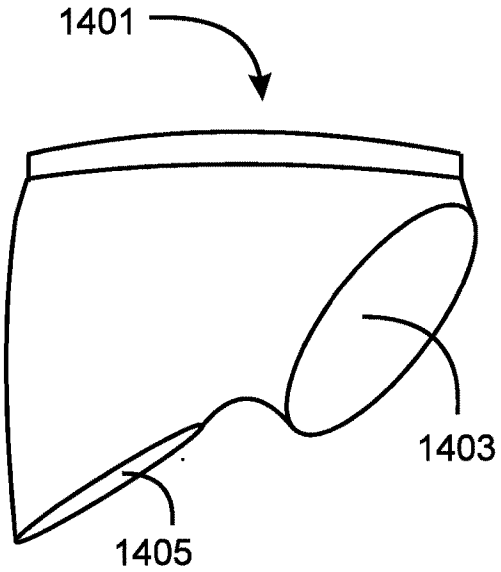

FIGS. 14A and B illustrate left and right portions 1401 and 1402 of another two-layer garment 1404 shown in FIG. 14C made much as is garment 1308. In this embodiment one leg of each constituent garment is of the bikini style, having opening 1403, and the other is longer, and cut at an angle, presenting opening 1405. When the two constituent garments are worn one over the other, the result is a two-layer garment 1404 with opposite leg openings at an angle. The bikini-style edges are still accessible and provide access, as described before, to the genital area.

It will be apparent to the skilled person that the constituent garments in these examples are mirror images, but this not a requirement. One might, for example don one bikini style garment as 1300, and one garment as in 1401, so the result has one longer leg, and one bikini leg. As long as each constituent garment has a bikini style opening opposite the other, the other leg may vary. This variation may in some implementations extend to the leg opposite the bikini opening being a knee length, or a full leg length, and all or part of the longer lag may be fabric other than the stretch fabric of the bikini potion.

Figure 15:
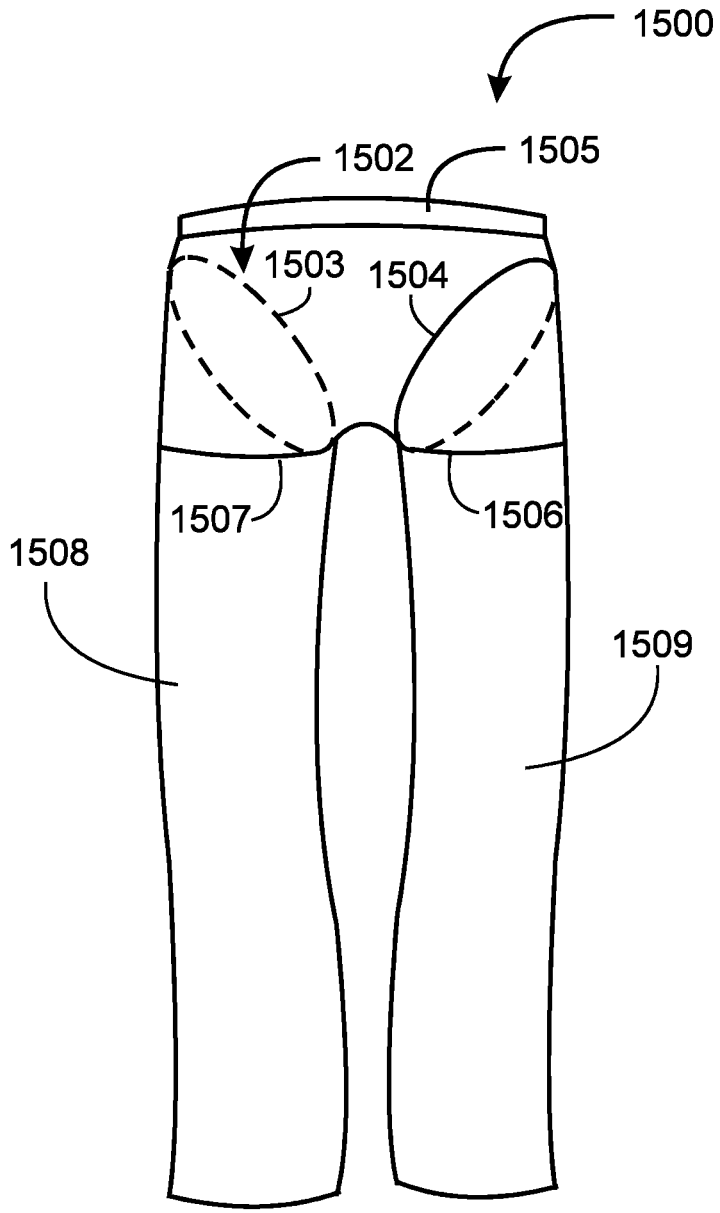
FIG. 15 is a front elevation view of a garment 1500 comprising a two-layer stretch booty-shorts portion 1502.

FIG. 15 is a front elevation view of a garment 1500 comprising a two-layer stretch booty-shorts portion 1502 with bikini-style leg openings 1503 and 1504, one each of each layer of the booty shorts, and a waistband 1505. Each mirror-image portion of the booty-shorts also has a straight leg opening noted as 1506 and 1507. The constituent bikini garments may be joined along a portion of the waistband. In this embodiment fabric lags 1508 and 1509 are joined to the straight leg openings leg openings at 1506 and 1507, such as by stitching. The fabric in one embodiment is a relatively heavy fabric such as canvas. It will be apparent to the skilled person that a garment with fabric legs of this sort may be made with any of the bikini or booty-short combinations described above, and having common leg openings is not a requirement. That is, the constituent parts of the two-layer stretch garment need not be mirror images. This compound garment still has accessible edges at 1503 and 1504. Further, it will be apparent that garment 1500 may be implemented with the straight leg booty shorts also described above.

Figure 16:
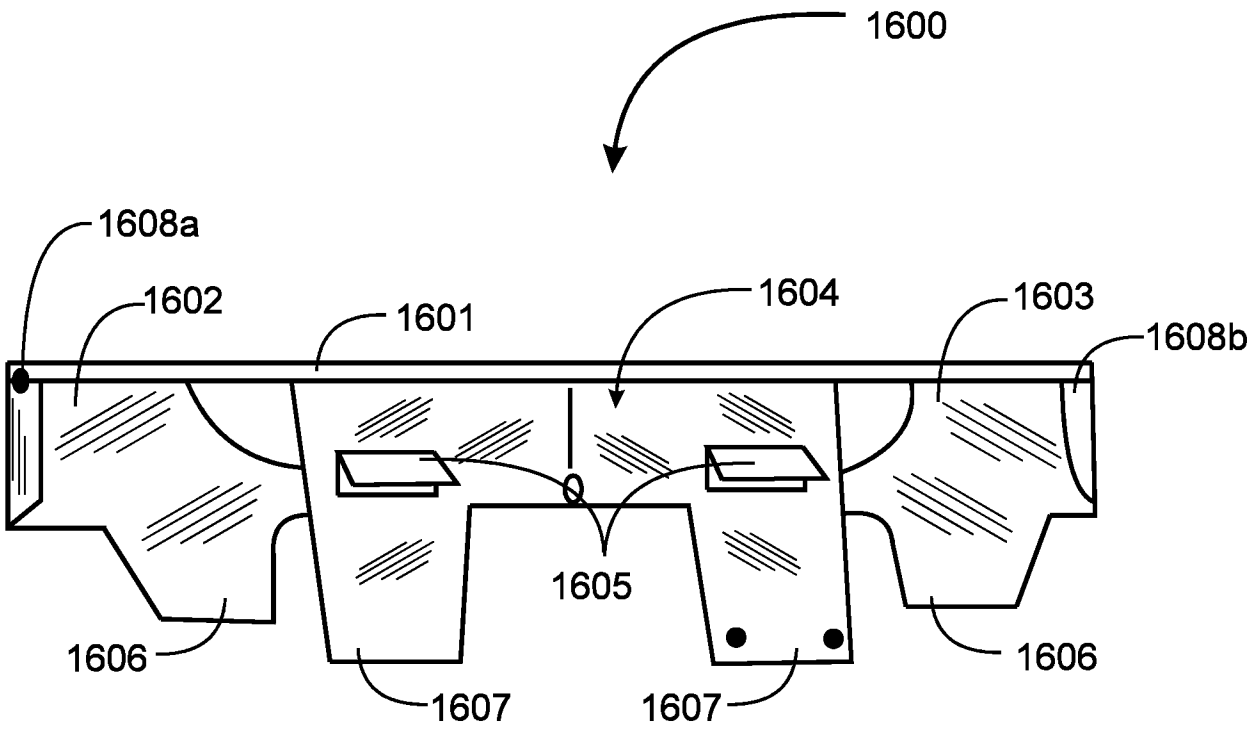
FIG. 16 is a layout, unfolded view of a work belt in an embodiment of the invention.

FIG. 16 is a layout, unfolded view of a work belt 1600 made of heavy fabric, such as canvas or leather. Alternatively the fabric could be light and thinner, as long as it is durable, such as rip stop nylon. Work belt 1600 has a waistband 1601, opposite front sections 1602 and 1603, and a back section 1604 having pockets 1605 with cover flaps. Although not shown there may be pockets on the front sections as well, with or without flaps. There are descending portions 1606 of the front sections and 1607 of the back section, that align with legs of a user or a user's garment when the work belt is worn. A closure element 1608*a* with a compatible element 1608*b*, such as a zipper, provides for donning the work belt and closing in front. The closure may be buttons, snaps, a zipper, or other closure elements in embodiments of the invention.

Figure 17B:
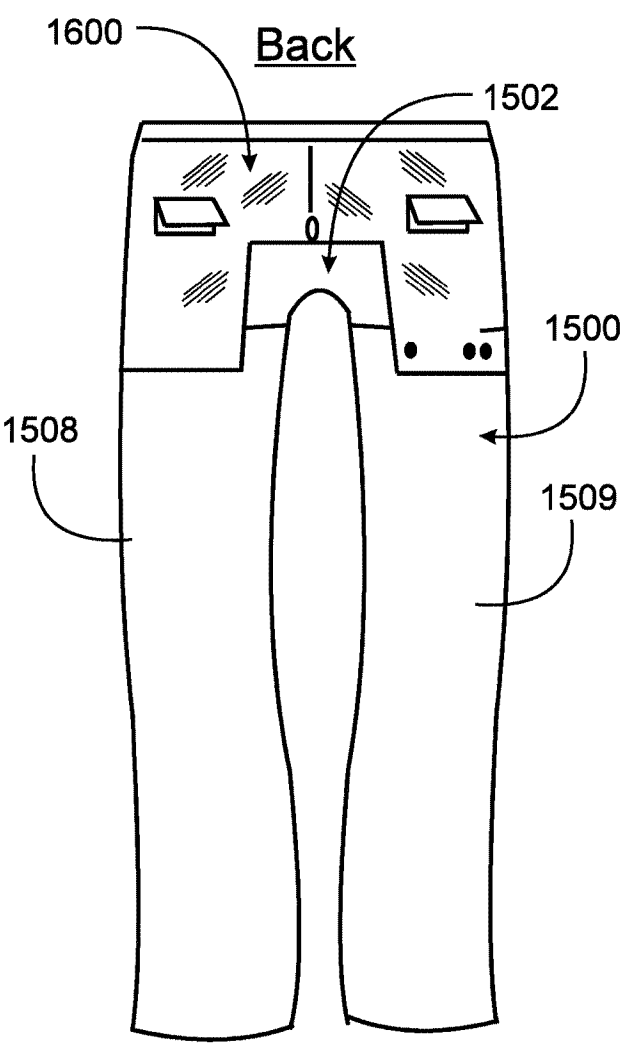
FIG. 17B is a back elevation view of a work belt worn over a compound garment in an embodiment of the invention.
Figure 17A:
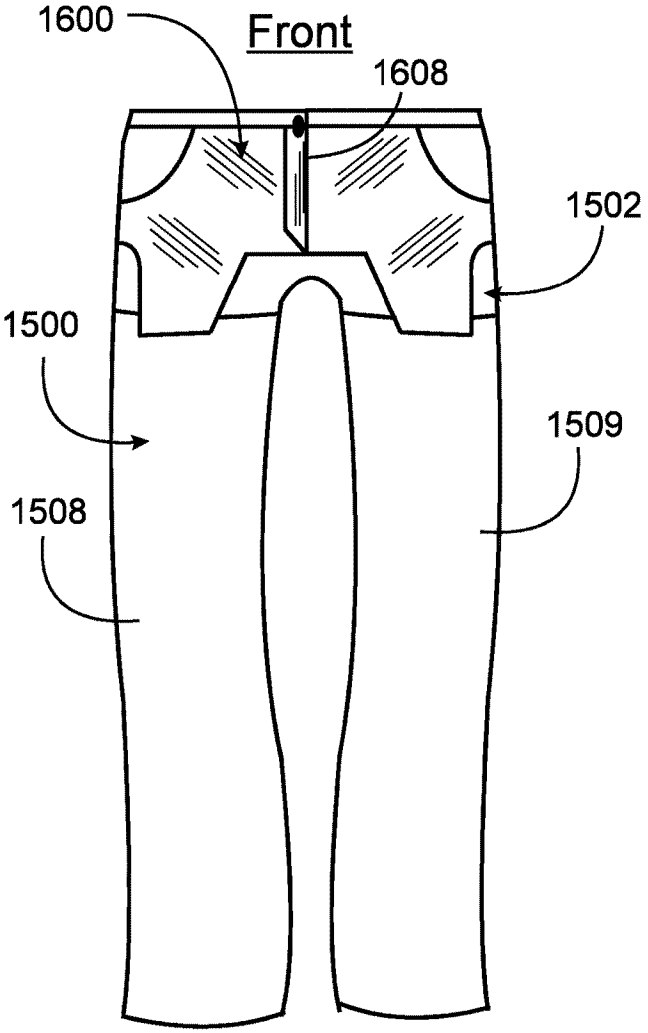
FIG. 17A is a front elevation view of a work belt worn over a compound garment in an embodiment of the invention.

FIG. 17A is a front elevation view of a work belt 1600 as seen in FIG. 16, worn over a compound garment 1500 comprising straight leg booty shorts 1502 and fabric legs 1508 and 1509, as seen in FIG. 15 in an embodiment of the invention. The opposite portions of the work belt are joined in the front by the fastening elements 1608.

FIG. 17B is a back elevation view of the work belt worn over the compound garment. It may be seen that with the work belt worn over the booty-shorts compound garment, the edges of the booty shorts are still accessible.

Figure 17C:
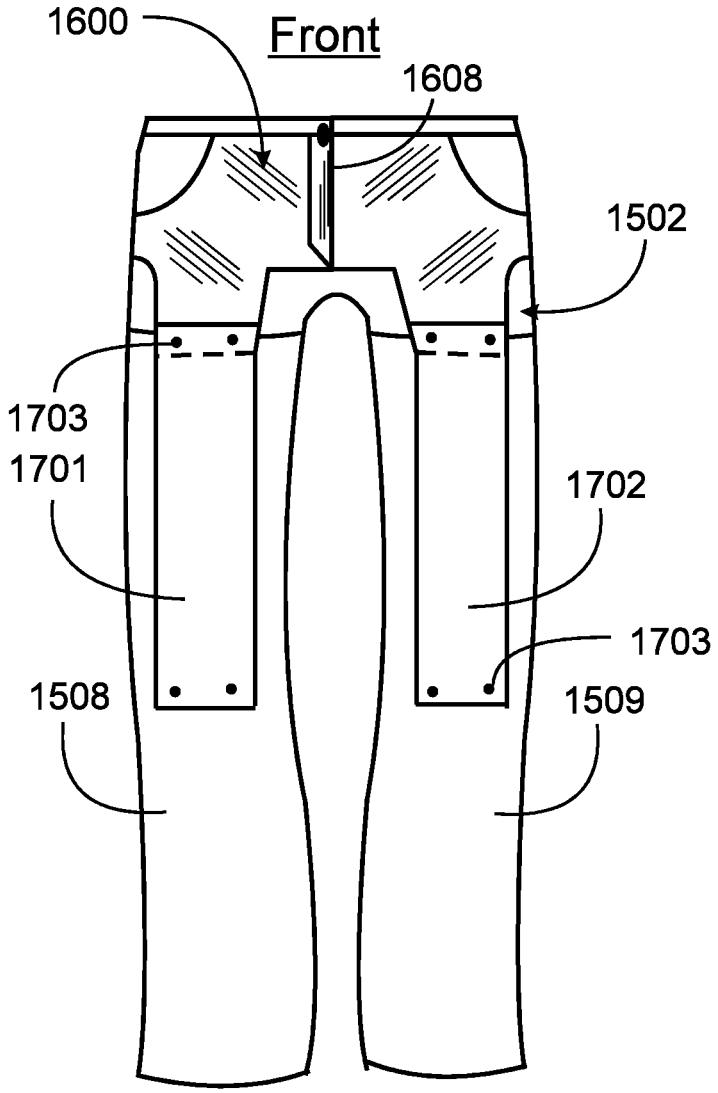
FIG. 17C is an alternative embodiment of a front elevation view of the work belt.

FIG. 17C is an elevation view of the compound garment of FIG. 17A, showing work belt 1600 worn over a booty shorts garment with fabric legs 1500 as illustrated in FIG. 15, with additional elements. In this example extended knee protectors 1701 and 1702 are fastened to the downward extending portions 1606 of the work belt in the front, and these may be riveted or otherwise fastened to the fabric legs on each side, such as by rivets 1703. Fastening may be by rivets, or by other fasteners as well. In some case the downward extending protectors may extend all or most of the way around the fabric legs. In this embodiment, the garment could serve as chaps for motorcycle riding, welding or other activity requiring leg protection.

In another embodiment work belt 1600 may be integrated with the outer pair of booty shorts. The outer booty shorts may be open down the front and sewn to the opposite sides of the closure 1608*a*, 1608*b*. In this implementation the outer pair of shorts may open with the zipper or other closure.

Figure 18A:
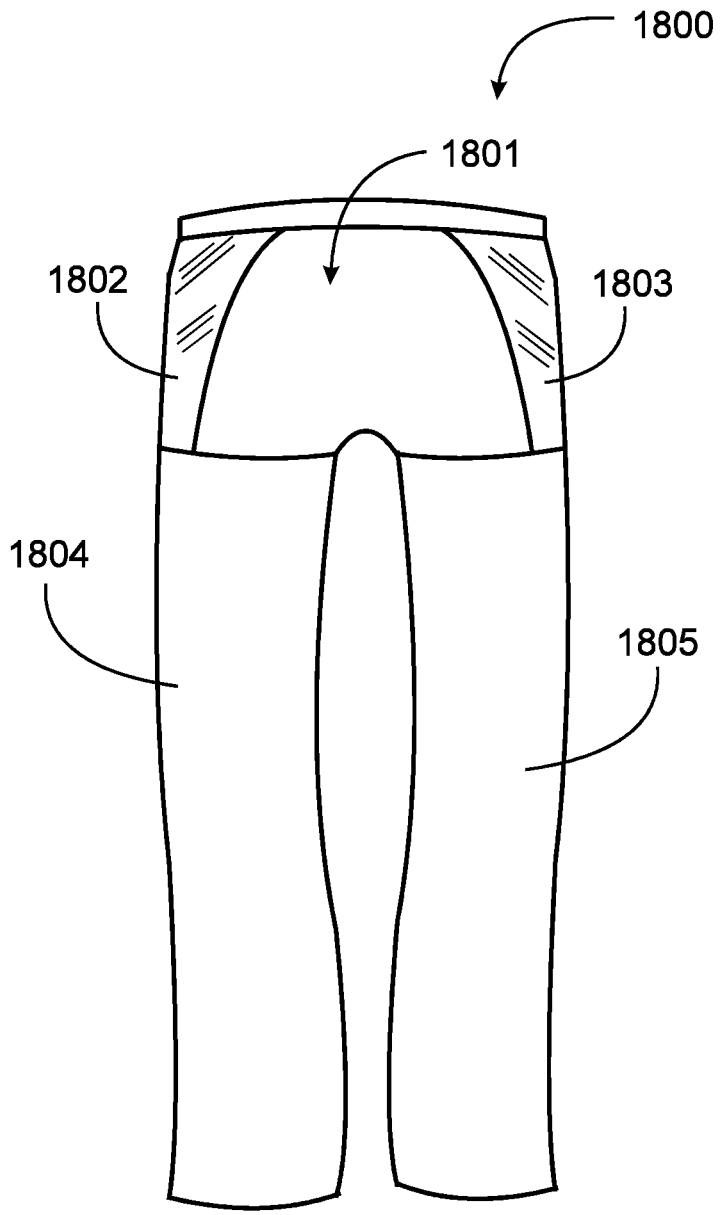
FIG. 18A is an elevation view of a garment in another embodiment of the invention.

FIG. 18A is an elevation view of a compound garment 1800 in yet another embodiment of the invention. In this example there are two overlapping garments, which may have stretch regions either with bikini-style leg openings or straight leg openings. In this example the overlapping garments have straight-leg design. Only the outer of the overlapping garments, labeled element 1801 may be seen in the figure.

Non-stretch fabric lags 1804 and 1805 are sewn one each to one leg opening of the inner garment, and to one leg opening of the outer garment. In this embodiment at least the outer garment has side regions 1802 and 1803 that are non-stretch fabric. The inner and outer layers may be sewn along the waist band, as described above. In one embodiment both the inner and the outer garment have non-stretch side regions.

Figure 18B:
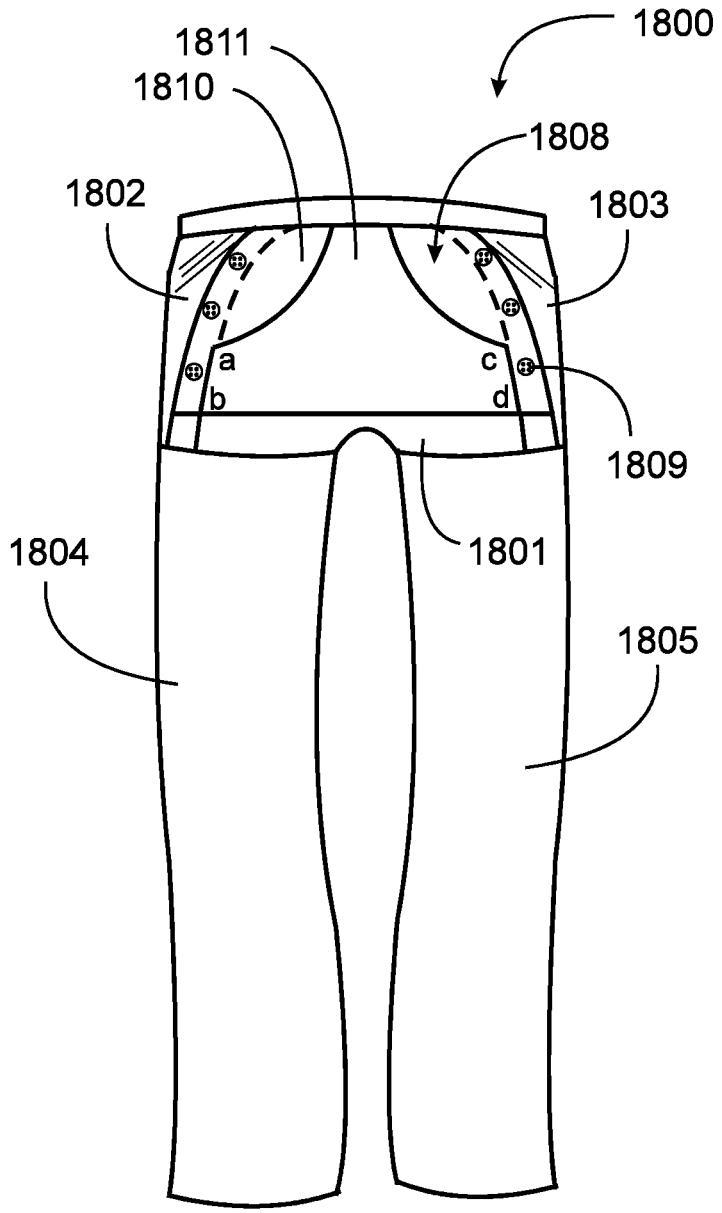
FIG. 18B shows the garment of FIG. 18A with additional elements.

FIG. 18B shows the garment of FIG. 18A with additional elements. In this example buttons 1809, three on side in the example, are sewn to the non-stretch fabric side portions of outer garment 1801. A non-stretch fabric panel 1810 having buttonholes positioned to match the buttons on sides of outer garment 1801 is joined to the outer garment. A second layer of fabric 1811 sewn to the fabric panel 1810 from a to b and from c to d, provides a pocket with two openings into the pocket, one from each side.

Figure 18C:
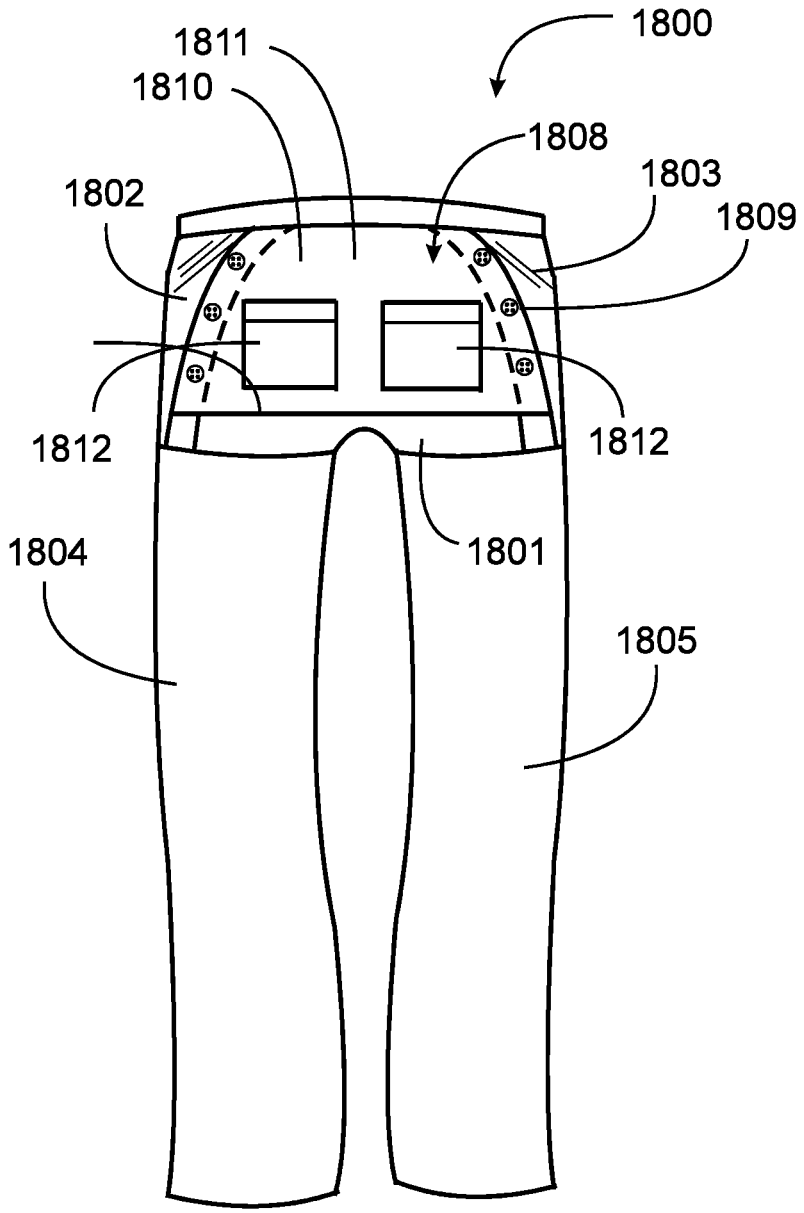
FIG. 18C shows the garment of 18B with added elements.

FIG. 18C is an elevation view of the compound garment of FIG. 18B, seen from the reverse, back side. A fabric panel 1811 having buttonholes is joined by buttons 1809 sewn to the fabric side portions of outer garment 1801, and this panel has separate pockets 1812. It may be seen in both FIGS. 18B and 18C that the wearer still has access to the genital region by virtue of the edges of the inner and outer garments.

Figure 19A:
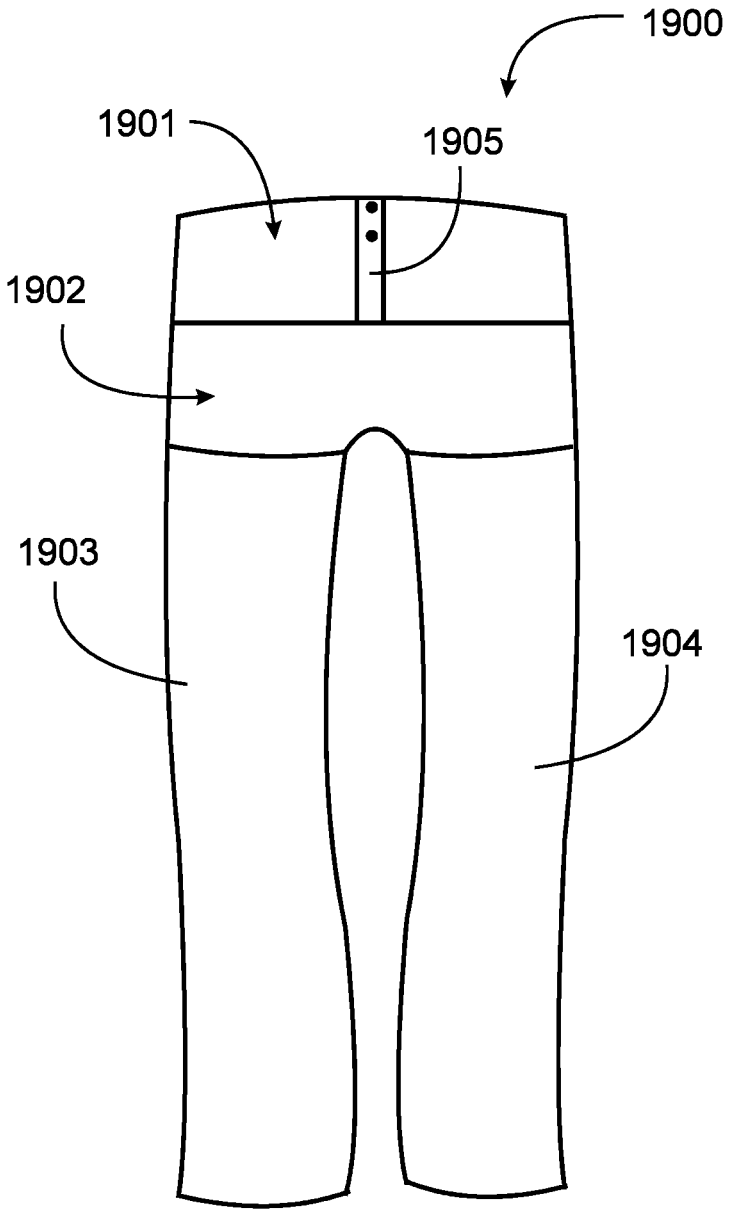
FIG. 19A is an elevation view of a compound garment in yet another embodiment of the invention, showing a front of the garment.

FIG. 19A is an elevation view of a compound garment in yet another embodiment of the invention, showing a front of the garment. This compound garment has a heavy fabric waistband portion 1901 that may be, for example, heavy fabric, leather, or canvas. Again, said fabric may be lightweight, as long as it is durable material, such as rip stop nylon. This waistband portion has a traditional fly 1905 that may be closed by a zipper, or buttons and the like. Two shorts garments or four-way stretch fabric are sewn one inside the other to a bottom circumference of heavy fabric waistband 1901. One, the outer shorts 1902, is visible in the figure and the inner one is not. One fabric leg is sewn to one leg opening of the outer shorts and one fabric leg is sewn to the leg opening of the inner shorts on the opposite side. This leaves one leg opening of each pair of shorts, one outer, one inner, available to be grasped and stretched in the manner described above for accessing the genital area. A user may open the fly in the heavy waistband to don the compound garment.

Figure 19B:
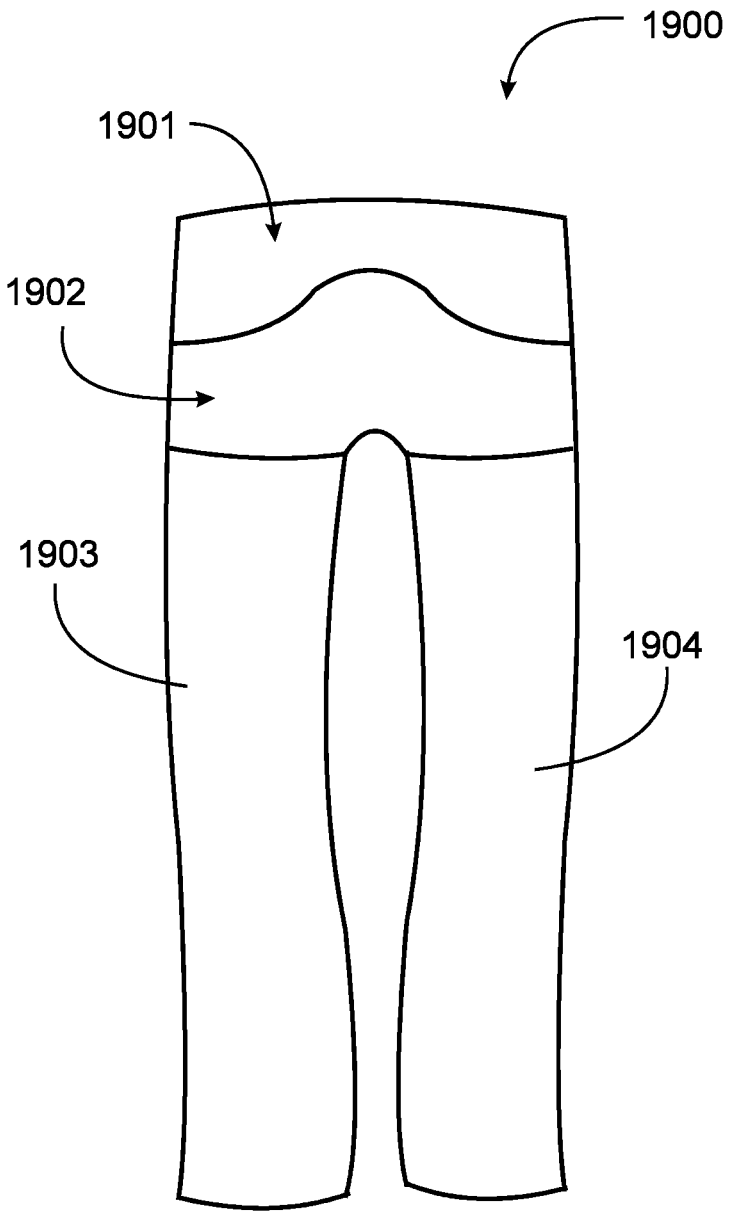
FIG. 19B is the compound garment of FIG. 19A, seen from the rear.

FIG. 19B is the compound garment of FIG. 19A, seen from the rear. There is no fly in the rear, and the difference is a different shape of the heavy waistband. The shape of the waistband is mostly arbitrary, and can many different shapes, including straight across.

Figure 20A:
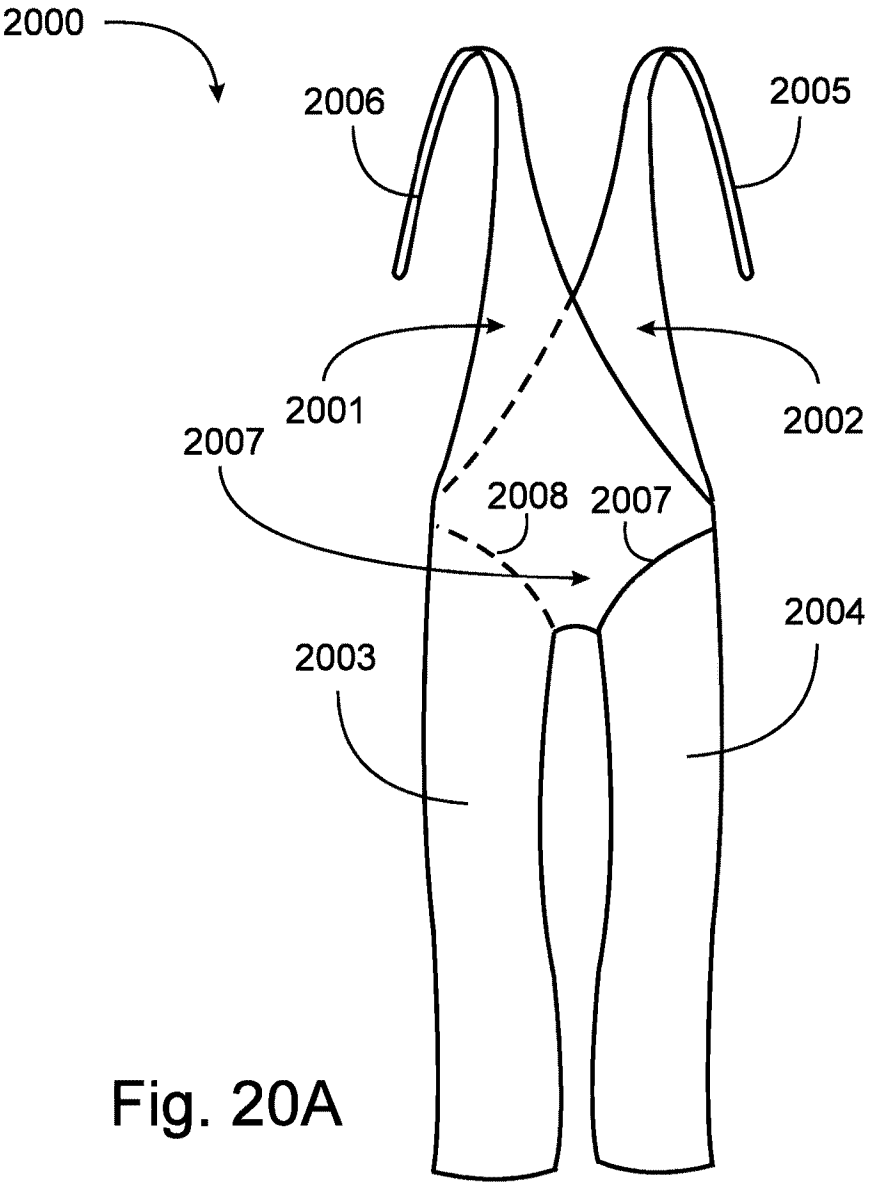
FIG. 20A is an elevation view of a simple compound onesie garment 2000 that is provided by two approximately mirror image garments 2001 and 2002.

FIG. 20 is an elevation view of a simple compound onesie garment 2000 that is provided by two approximately mirror image garments 2001 and 2002, one worn over the other as in other embodiments of the invention. Garment 2001, worn over in this example, has a leg 2003, a bikini style leg opening 2007 opposite leg 2003, and a strap portion 2006 shown dangling over a shoulder area down the back.

Garment 2002, worn under in this example, has a leg 2004, a bikini style leg opening 2008 opposite leg 2004, indicated as dotted line because it is covered by garment 2001, and a strap portion 2005 also shown dangling over a shoulder area down the back.

In one embodiment the entire extent of both garments 2001 and 2001 may be of the four-way stretch fabric described above for such as bikini and booty shorts, but this is not a limitation. Parts of the garments may be non-stretch fabric, such as the legs and the upper regions with the straps. It is necessary that the pelvic region 2007, both front and back, be made of stretch fabric, preferably, of four-way stretch material.

As in other embodiments a user will don one garment 2002 (the inside) and then the other (2001) the outside. The straps may be over the shoulders and tied in various ways, or even wrapped around the body below the shoulders.

It will be apparent to the skilled person that there are many alterations and modifications that may be made in different embodiments of the invention without departing from the clear scope of the invention. Many differences in material, characteristics of material, structure, and so on, have been described in the specification with regard to the drawing figures, and many more are possible. The scope and breadth of the invention is limited only by the language of the claims.

The invention claimed is:

1. A compound garment, comprising:

a first garment of contiguous material from a first waist edge to a genital area, having opposite leg openings proximate the genital area, with at least a pelvic region made from a four-way stretch fabric;

a second garment of contiguous material from a second waist edge to a genital area, having opposite leg openings proximate the genital area, with at least a pelvic region made from a four-way stretch fabric; and a waist band of non-stretch fabric, having a contiguous back portion and a front portion with a fly opening having closure elements enabling the fly opening to be opened and closed;

wherein the compound garment is formed by imposing the second garment over the first garment with first and second waist edges and leg openings aligned, imposing the non-stretch waistband over the assembled first and second garments at the waist edges, and joining the first and second waist edge along the waistband in the back.

2. The compound garment of claim 1 wherein one or more of the leg openings of the first and second garments are bikini-style openings.

3. The compound garment of claim 1 wherein one or more of the leg openings of the first and second garments are straight leg style openings.

4. The compound garment of claim 1 further comprising legs of non-stretch fabric joined to the leg openings and extending downward.

5. The compound garment of claim 4 wherein the leg openings extend downward less than knee length.

6. The compound garment of claim 4 wherein the leg openings extend downward more than knee length.

7. The compound garment of claim 1 wherein the non-stretch waistband comprises a downwardly extending back region overlying the first and second garments, the back region comprising at least one pocket.

8. The compound garment of claim 1 wherein the non-stretch waistband further comprises mirror-image front regions overlying the first and second garments, the front regions separated by the fly opening and extending downward to about the genital area, such that with the fly open, the front regions are enabled to fold back away from the first and second garments.

9. The compound garment of claim 8 further comprising additional protectors joined to the front regions, covering a portion of the fabric legs below the front regions.

10. The compound garment of claim 9 wherein the additional protectors are joined at a lower extremity to the fabric legs by fasteners.

11. The compound garment of claim 10 wherein the additional protectors extend laterally around the leg portions.

12. The compound garment of claim 1 further comprising non-fabric side portions implemented on the second, outer garment, leaving the pelvic region as four-way stretch fabric.

13. The compound garment of claim 12 further comprising openable fastener elements, such as buttons, along front edges of the side portions, and a non-fabric front panel with mating fastener elements assembled across the front from side panel to side panel.

14. The compound garment of claim 13 further comprising one or more pockets implemented on an outside surface of the non-fabric front panel.

15. The compound garment of claim 13 further comprising openable fastener elements, such as buttons, along back edges of the side portions, and a non-fabric back panel with mating fastener elements assembled across the back from side panel to side panel.

16. The compound garment of claim 15 further comprising one or more pockets implemented on an outside surface of the non-fabric back panel.

17. The compound garment of claim 1 wherein the first and second garments are joined to a bottom edge of the non-fabric waist band.

18. A compound garment, comprising:

a first garment of contiguous material from a waist area to a genital area, having opposite leg openings proximate the genital area, with at least a pelvic region made from a four-way stretch fabric, and a first portion extending upward from the waist area, tapering to a first shoulder strap of a substantial length; and a second garment of contiguous material from a waist area to a genital area, having opposite leg openings proximate the genital area, with at least a pelvic region made from a four-way stretch fabric, and a second portion extending upward from the waist area, tapering to a second shoulder strap of a substantial length;

wherein the compound garment is formed by imposing the second garment over the first garment, with the leg openings aligned in a manner enabling a first edge of one of the leg openings in the first garment to be pulled away from the genital area and a second edge of one of the leg openings in the second garment to be pulled away from the genital area, thereby creating a fly opening in the compound garment.

19. The compound garment of claim 18 further comprising a first non-fabric leg element joined to one leg opening of the first garment, and a second non-fabric leg element of the second garment joined one leg opening of the second garment, such that two side-by-side leg elements are presented, and leg openings not joined to a fabric leg element create the fly opening.

* * * * *